US011382480B2

(12) United States Patent
Jang et al.

(10) Patent No.: US 11,382,480 B2
(45) Date of Patent: Jul. 12, 2022

(54) AUTONOMOUS CLEANER

(71) Applicant: Samsung Electronics Co., Ltd., Suwon-si (KR)

(72) Inventors: Hwi-Chan Jang, Suwon-si (KR); Tae Soo Kim, Suwon-si (KR); Hyun Soo Jung, Seongnam-si (KR); Sang Hwa Choi, Seoul (KR); Sang Sik Yoon, Yongin-si (KR); Shin Kim, Hwaseong-si (KR); Jin Hee Kim, Incheon (KR); Yeon Kyu Jeong, Suwon-si (KR); Hak Bong Lee, Suwon-si (KR); Young Ho Ko, Suwon-si (KR); Kyoung Woung Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 426 days.

(21) Appl. No.: 16/152,733

(22) Filed: Oct. 5, 2018

(65) Prior Publication Data

US 2019/0029489 A1 Jan. 31, 2019

Related U.S. Application Data

(62) Division of application No. 14/632,116, filed on Feb. 26, 2015, now Pat. No. 10,130,234.

(30) Foreign Application Priority Data

Feb. 28, 2014 (KR) ..... 10-2014-0024145
Jun. 13, 2014 (KR) ..... 10-2014-0072439

(51) Int. Cl.
*A47L 11/40* (2006.01)
*A47L 11/33* (2006.01)

(52) U.S. Cl.
CPC ..... *A47L 11/4066* (2013.01); *A47L 11/33* (2013.01); *A47L 11/4013* (2013.01); *A47L 2201/00* (2013.01)

(58) Field of Classification Search
CPC .. A47L 11/4066; A47L 11/33; A47L 11/4013; A47L 2201/00
See application file for complete search history.

(56) References Cited

U.S. PATENT DOCUMENTS

2002/0153185 A1 10/2002 Song
2004/0031113 A1 2/2004 Wosewick et al.
(Continued)

FOREIGN PATENT DOCUMENTS

EP 1139845 10/2001
EP 2085009 8/2009
(Continued)

OTHER PUBLICATIONS

European Communication under Rule 71(3) dated Mar. 14, 2019 in European Patent Application No. 15156401.0.
(Continued)

*Primary Examiner* — Andrew A Horton
(74) *Attorney, Agent, or Firm* — Staas & Halsey LLP

(57) ABSTRACT

An autonomous cleaner includes a body having a first housing formed at a front and a second housing formed at a rear of the first housing; a brush unit installed at the first housing and configured to sweep and collect dust from a floor; a dust collecting unit installed at the second housing and configured to store the dust inlet into the brush unit; a driving unit to drive the body and coupled to the second housing to be positioned at a lateral side of the dust collecting unit; and a power unit installed at the second housing and coupled to be positioned at a rear of the dust collecting unit. The miniaturization of the autonomous
(Continued)

cleaner may be provided while at the same time the capacity of a dust collecting container and the capacity of a battery are increased.

5 Claims, 21 Drawing Sheets

(56) References Cited

U.S. PATENT DOCUMENTS

2005/0055792 A1 3/2005 Kisela et al.
2006/0260087 A1* 11/2006 Im ..... A47L 9/009 15/319
2007/0157415 A1 7/2007 Lee
2008/0092325 A1* 4/2008 Vander Baan ..... A47L 11/4075 15/328
2008/0222837 A1* 9/2008 Kaffenberger ..... A47L 9/2852 15/319
2011/0099747 A1 5/2011 Kim
2012/0011669 A1 1/2012 Schnittman et al.
2012/0023699 A1 2/2012 Shim
2013/0261867 A1 10/2013 Burnett
2014/0182627 A1 7/2014 Williams
2014/0379127 A1* 12/2014 Tsuboi ..... B25J 9/1602 700/245
2015/0173577 A1 6/2015 Kim

FOREIGN PATENT DOCUMENTS

JP 5159934 B1 3/2013
KR 10-2009-0053983 5/2009
KR 10-2009-0084227 8/2009
WO 2007/028049 3/2007

OTHER PUBLICATIONS

Extended European Search Report dated Jul. 28, 2015 in European Patent Application No. 15156401.0.
U.S. Notice of Allowance dated Sep. 5, 2018 in U.S. Appl. No. 14/632,116.
U.S. Office Action dated Feb. 15, 2018 in U.S. Appl. No. 14/632,116.
U.S. Office Action dated Oct. 16, 2017 in U.S. Appl. No. 14/632,116.
U.S. Office Action dated Jul. 27, 2017 in U.S. Appl. No. 14/632,116.
U.S. Appl. No. 14/632,116, filed Feb. 26, 2015, Hwi-Chan Jang, et al., Samsung Electronics Co., Ltd.
Korean Office Action dated Sep. 30, 2019 in Korean Patent Application No. 10-2014-0024145.

* cited by examiner

AUTONOMOUS CLEANER

CROSS-REFERENCE TO RELATED APPLICATIONS

This application is a divisional application of U.S. patent application Ser. No. 14/632,116, filed on Feb. 26, 2015, which claims the priority benefit of Korean Patent Application No. 10-2014-0024145, filed on Feb. 28, 2014, and Korean Patent Application No. 10-2014-0072439, filed on Jun. 13, 2014, in the Korean Intellectual Property Office, the disclosures of which are incorporated herein by reference.

BACKGROUND

1. Field

The following description relates to an autonomous cleaner, and more particularly, an autonomous cleaner provided with a miniaturized size thereof and at the same time, capable of enhancing driving performance and cleaning performance.

2. Description of the Related Art

In general, an autonomous cleaner is an apparatus, by inletting a foreign substance such as dust from a floor while independently driving at an area to be cleaned without manipulations of a user, configured to autonomously clean the area to be cleaned.

The autonomous cleaner as such is provided to detect information on the distance with respect to an obstacle such as furniture, office equipment, or a wall installed inside the area to be cleaned by use of various sensors, and to clean the area to be cleaned while driving without colliding with the obstacle by use of the detected information.

Cleaning of a given area to be cleaned by use of the autonomous cleaner refers to a process of repeatedly performing a cleaning work while driving according to a predetermined driving pattern.

The autonomous cleaner as such includes a body forming an exterior appearance, a driving unit provided at the body to drive the autonomous cleaner, a brush unit configured to perform a cleaning with respect to a floor surface, the driving unit, a control unit configured to control driving of the driving unit and the brush unit, and a dust collecting unit configured to store the inlet dust.

The autonomous cleaner is conventionally arranged such that the dust collecting unit is connected to the brush unit and an inlet motor is connected to a rear or front of the dust collecting unit. In the case as such, the sizes of a power unit and the inlet motor are increased to enhance driving performance and cleaning performance of the autonomous cleaner, and thus the size of the entire autonomous cleaner is increased.

SUMMARY

Therefore, it is an aspect of the present disclosure to provide an autonomous cleaner provided with a miniaturized size of the autonomous cleaner by efficiently structuring a position of each of the elements structuring the autonomous cleaner, and at the same time, capable of enhancing driving performance and cleaning performance Additional aspects of the disclosure will be set forth in part in the description which follows and, in part, will be obvious from the description, or may be learned by practice of the disclosure.

In accordance with an aspect of the present disclosure, an autonomous cleaner includes a body having a first housing formed at a front and a second housing formed at a rear of the first housing; a brush unit installed at the first housing and configured to sweep and collect dust from a floor; a dust collecting unit installed at the second housing and configured to store the dust inlet into the brush unit; a driving unit to drive the body and coupled into the second housing to be positioned at a lateral side of the dust collecting unit; and a power unit installed at the second housing and coupled to be positioned at a rear of the dust collecting unit.

A front unit of the first housing may be provided in the shape of a rectangle to inlet dust while closely attached to a front and side surfaces of a driving direction.

A bumper installed at the front of the first housing to wrap around at least a portion of the first housing may be further included.

A plurality of ribs protruding toward a front of the bumper to increase an inlet force at the time of when the bumper is closely attached to the front may be provided at the front of the bumper.

A guide flow path configured to guide dust into the brush unit to increase an inlet force of the dust may be formed at a lower surface of the first housing.

The height between a floor surface and the first housing may be less than the height between the floor surface and the second housing.

An obstacle detecting sensor to detect obstacles to avoid the obstacles may be mounted at the first housing.

A fall detecting sensor provided to detect the distance with respect to the floor surface during driving of the body may be mounted at the first housing.

The dust collecting unit may include an inlet motor configured to provide a driving force to have the dust inlet, and a dust collecting container to store the inlet dust.

The inlet motor, the dust collecting container, and the driving unit may be disposed in a row.

At least a portion of the dust collecting container may be coupled into the second housing to be exposed as an exterior appearance.

The driving unit may include driving wheels coupled into both side surfaces to drive the body, and a roller provided at a rear of the body.

The driving wheels are provided to be positioned at both sides of the body, and the roller may be coupled into a position to support the center of gravity of the body.

In accordance with an aspect of the present disclosure, an autonomous cleaner includes a body having a housing forming at least a portion of an exterior appearance; a brush unit installed at a lower surface of the housing to collect the dust on a floor; a dust collecting container to store the dust inlet into the brush unit; and a power unit to supply a power to drive the body, and the brush unit, the dust collecting container, and the power unit are provided to be disposed toward a first direction, that is, a longitudinal direction of the body.

The dust collecting container is disposed at a rear of the brush unit, and the power unit may be disposed at a rear of the dust collecting container.

The housing includes a first housing disposed at a front, and a second housing positioned at a rear of the first housing, and the brush unit and the dust collecting container may be disposed at the first housing while the power unit may be disposed at the second housing.

A bumper installed at a front of the first housing to wrap around at least a portion of the first housing may be further included.

A guide flow path configured to guide dust into the brush unit to increase an inlet force of the dust may be formed at a lower surface of the first housing.

A driving unit configured to drive the body and installed at the second housing, and the power unit installed at the second housing and configured to supply power to drive the body may be further included.

An inlet motor configured to provide a driving force to have the dust inlet into the dust collecting container and coupled into a side surface of the dust colleting container may be further included.

In accordance with an aspect of the present disclosure, an autonomous cleaner including a body and a brush unit to sweep and collect dust on a floor includes a dust collecting container to store the dust inlet into the brush unit; an inlet motor to provide a driving force to have dust inlet into the dust collecting container; and at least one driving wheel coupled into a side surface of the body to drive the body, and the dust collecting container, the inlet motor, and the driving wheel are provided to be disposed toward a lateral direction of the body.

The driving wheel includes a first driving wheel and a second driving wheel, and the first driving wheel may be disposed at a side surface of the inlet motor and the second driving wheel may be disposed at a side surface of the dust collecting container.

The body may be structured by use of a first housing positioned at a front and a second housing positioned at a rear of the first housing.

The dust collecting container, the driving wheel, and the inlet motor may be positioned at the second housing.

The brush unit is disposed at the first housing, and the power unit configured to provide power to drive the body may be disposed at the second housing.

In accordance with an aspect of the present disclosure, an autonomous cleaner includes a body having a housing forming at least a portion of an exterior appearance; a brush unit installed at a lower surface of the housing to collect the dust on a floor; a dust collecting unit disposed at a rear of the brush unit to store the dust inlet into the brush unit; a driving unit configured to drive the body and disposed at a side of the dust collecting unit; and a power unit configured to provide a power to drive the body and coupled into a rear of the dust collecting unit, and the brush unit, the dust collecting unit, and the power unit are provided to be disposed toward a first direction, and the dust collecting unit and the driving unit are provided to be disposed toward a second direction that is different from the first direction.

The housing includes a first housing disposed at a front, and a second housing positioned at a rear of the first housing, and the brush unit and the dust collecting unit may be disposed at the first housing while the driving unit and the power unit may be disposed at the second housing.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
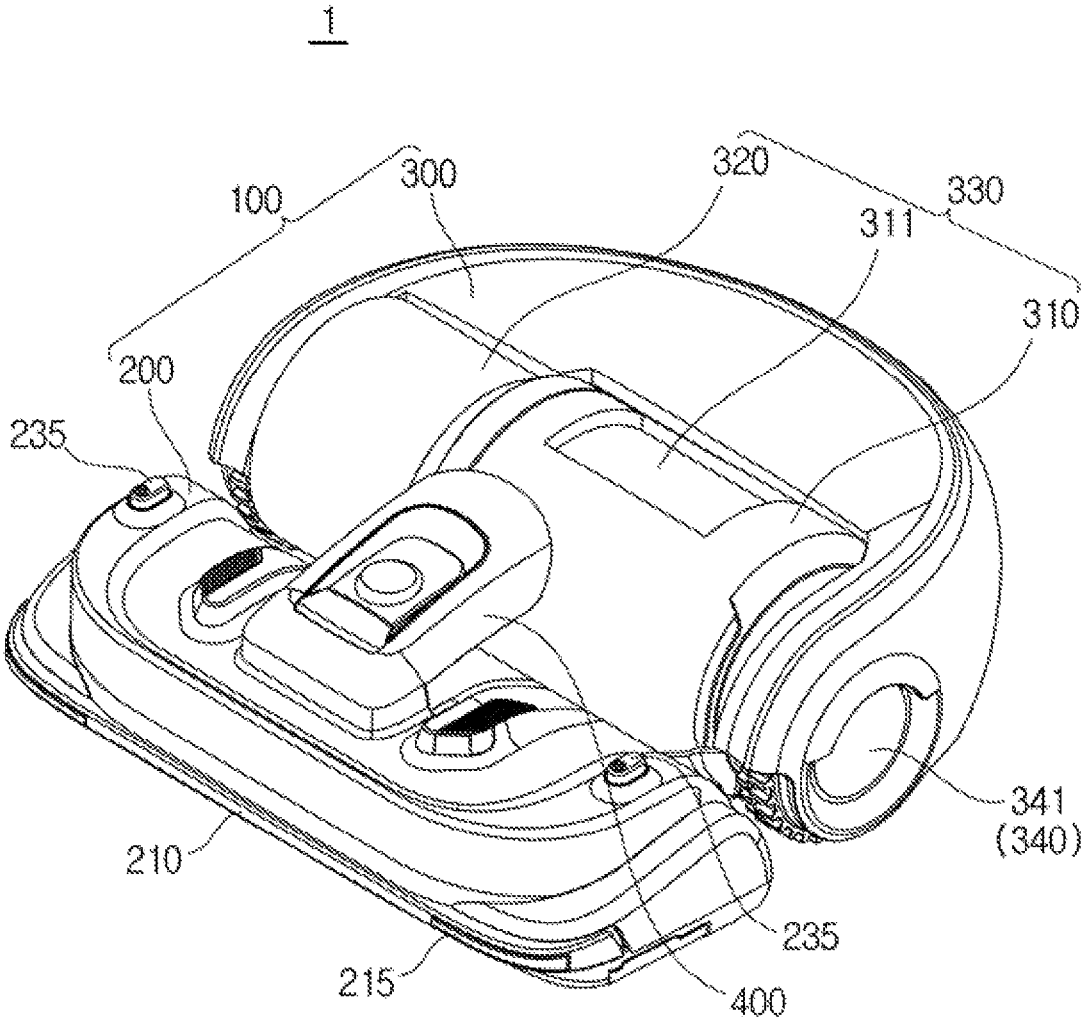
FIG. 1 is a perspective view illustrating an exterior appearance of an autonomous cleaner in accordance with an embodiment of the present disclosure.

Reference will now be made in detail to the embodiments of the present disclosure, examples of which are illustrated in the accompanying drawings, wherein like reference numerals refer to like elements throughout.

FIG. 1 is a perspective view illustrating an exterior appearance of an autonomous cleaner in accordance with an embodiment of the present disclosure.

As illustrated on FIG. 1, an autonomous cleaner 1 includes a body forming an exterior appearance, and a housing 100 forming at least a portion of the exterior appearance of the body.

The housing 100 includes a first housing 200 formed at a front, and a second housing 300 formed at a rear of the first housing 200. A connecting member 400 to connect the first housing 200 and the second housing 300 may be positioned between the first housing 200 and the second housing 300. In accordance with an embodiment of the present disclosure, the first housing 200 and the second housing 300 are integrally injection-molded, but are not limited hereto, and the first housing 200 and the second housing 300 may be injection-molded and then coupled to each other.

A dust collecting unit 330 structured to store dust may be coupled to the second housing 300, and may include an inlet motor 320 to provide a driving force to inlet dust, and a dust collecting container 310 to store the inlet dust.

A gripping unit 311 concavely provided to be gripped by a user may be provided at the dust collecting container 310. The user may be able to separate the dust collecting container 310 from the second housing 300 by rotating the dust collecting container 310 by gripping the gripping unit 311. The user may be able to remove the accumulated dust inside the dust collecting container 310 by separating the dust collecting container 310. Driving units 340 and 360 to drive the body may be provided at sides of the second housing 300. The driving units 340 and 360 may include driving wheels 340 configured for driving of the body, and a roller 360 (FIG. 4) provided to be rotated to minimize driving load of the body. In accordance with an embodiment of the present disclosure, the driving wheels 340 may be coupled to both side surfaces of the second housing 300.

A brush unit 220 (FIG. 4) configured to sweep and collect dust from a floor may be provided at an upper surface of the first housing 200. A bumper 210, which is configured to ease noise and impact that are generated if the autonomous cleaner 1 collides with a wall at the time of when the autonomous cleaner 1 is in a driving state, may be coupled to a front surface unit of the first housing 200. In addition, a separate buffer member 215 may be coupled to the bumper 210, and descriptions of the buffer member 215 will be provided later.

An entry blocking sensor 235 may be protrudedly provided at an upper surface of the first housing 200. The entry blocking sensor 235, by detecting infrared light, may be able to prevent an entry of the autonomous cleaner 1 into a predetermined section. In accordance with an embodiment of the present disclosure, the entry blocking sensor 235 may be provided at each of both sides of the first housing 200.

Figure 2:
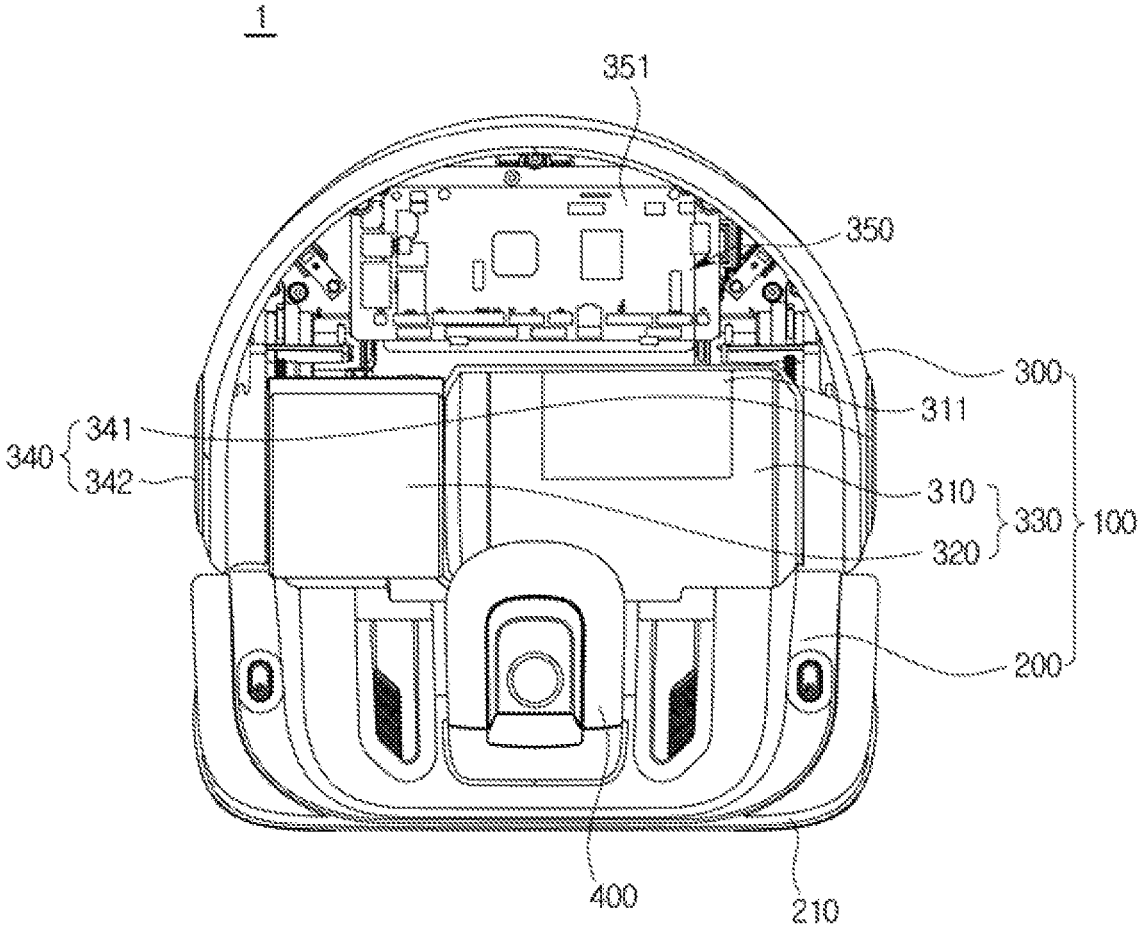
FIG. 2 is a plane view illustrating a state of an outer housing of a second housing of the autonomous cleaner removed in accordance with an embodiment of the present disclosure.
Figure 3:
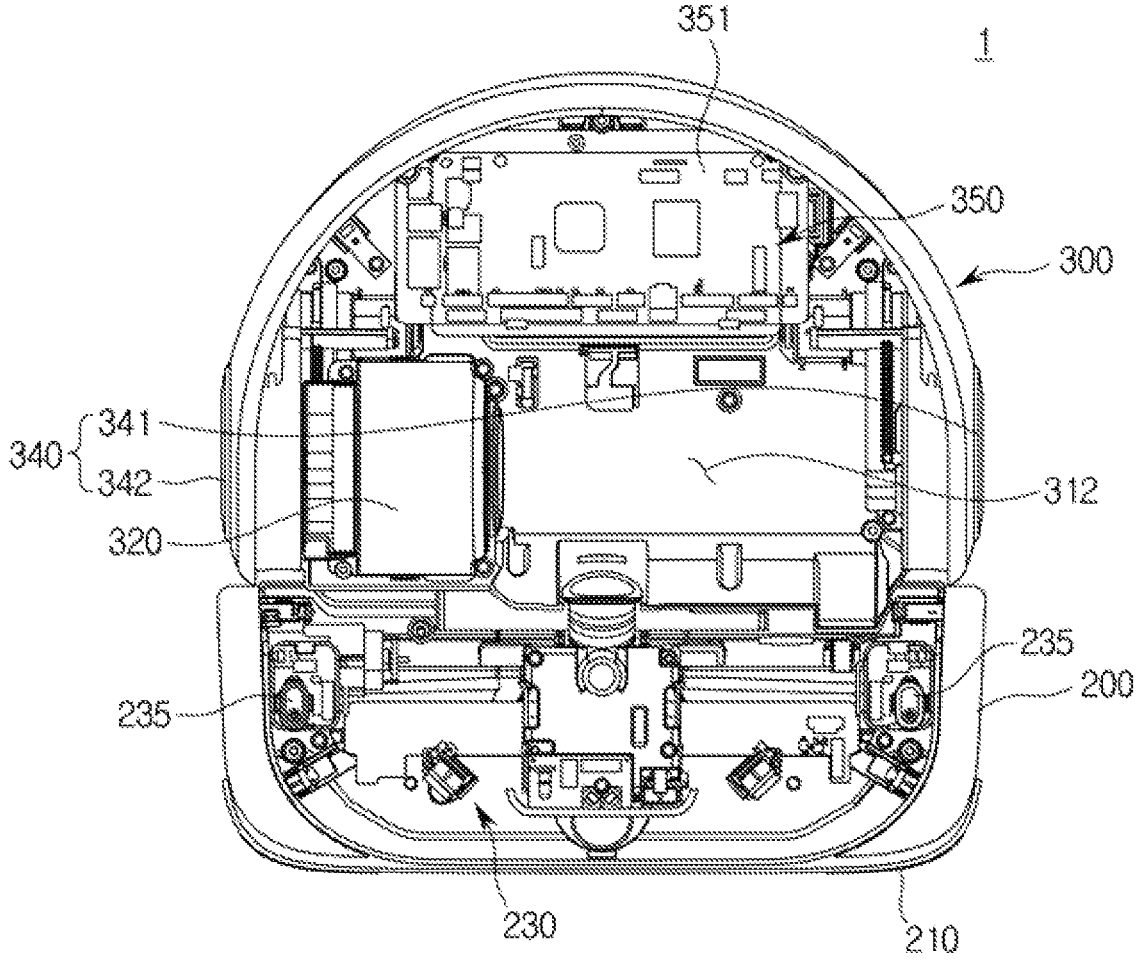
FIG. 3 is a plane view illustrating a state of outer housings and dust containers of a first housing and the second housing of the autonomous cleaner removed in accordance with an embodiment of the present disclosure.

FIG. 2 is a plane view illustrating a state of an outer housing of the second housing of the autonomous cleaner removed in accordance with an embodiment of the present disclosure, and FIG. 3 is a plane view illustrating a state of outer housings and dust containers of the first housing and the second housing of the autonomous cleaner removed in accordance with an embodiment of the present disclosure.

As illustrated on FIG. 2 and FIG. 3, a power unit 350 configured to supply power to drive the body may be coupled to an inner side of the second housing 300. The power unit 350 is positioned at upper sides of a battery (not shown) and a main board 351, and may include a display unit 352 (FIG. 7) configured to display the status of the autonomous cleaner 1. The power unit 350 may be disposed to be positioned at a rear of the dust collecting unit 330.

The battery (not shown) is provided in the form of a rechargeable secondary battery, and in a case when the body is coupled to a docking station (not shown) after completing a cleaning process, the battery is supplied with a power from the docking station (not shown) and is recharged.

When the dust collecting container 310 is removed, a draft fan (not shown) configured to inlet dust and move the dust into the dust collecting container 310 may be provided. Dust is accumulated at the dust collecting container 310 by use of the driving of the draft fan (not shown), and a user may be able to easily discharge the dust by separating the dust collecting container 310.

Figure 7:
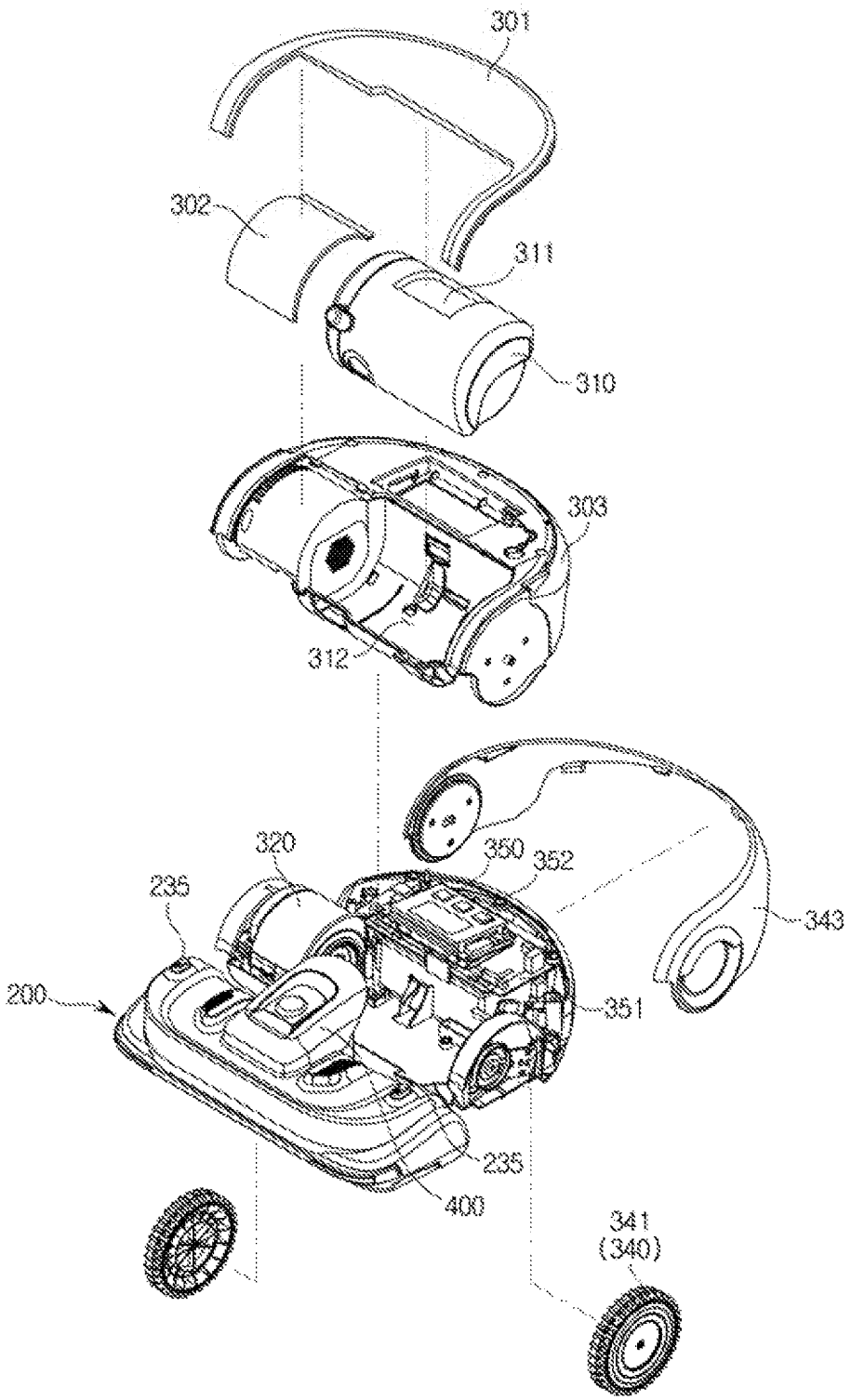
FIG. 7 is a drawing illustrating a disassembled state of structuring elements of the second housing of the autonomous cleaner in accordance with an embodiment of the present disclosure.

The inlet motor 320 may be positioned at an inner side of an inlet motor housing 302 (FIG. 7). The inlet motor 320 may be coupled to a side surface of the dust collecting container 310. In accordance with an embodiment of the present disclosure, the driving wheel 340 may be disposed at a side surface of the each of the dust collecting container 310 and the inlet motor 320. That is, the driving wheel 340 includes a first driving wheel 341 and a second driving wheel 342, and the first driving wheel 341 may be disposed at a side surface of the inlet motor 320, and the second driving wheel 342 may be disposed at a side surface of the dust collecting container 310.

According to the above, the dust collecting container 310, the inlet motor 320, and the driving wheels 340 may be disposed in a lateral direction of the body. That is, the dust collecting container 310, the inlet motor 320, and the driving wheels 340 may be disposed to approximately be in a straight line.

The second housing 300 may include a dust collecting container installation unit 312 at which the dust collecting container 310 is installed. In accordance with an embodiment of the present disclosure, at least a portion of the dust collecting container 310 may be coupled to the dust collecting container installation unit 312 to be exposed as an exterior appearance. That is, no separate housing is coupled to an upper surface of the dust collecting container 310. According to the above, a user may be able to check the amount of the dust inside the dust collecting container 310 by use of a naked eye.

An obstacle detecting sensor 230 configured to detect obstacles may be provided inside the first housing 200, and will be described later.

The front surface unit of the first housing 200 may be formed in the shape of a rectangle to inlet dust while closely attached to the front surface and the side surface of a driving direction, and to approach a surface of a wall as closely as possible, so that inletting dust may take place. The autonomous cleaner 1 in accordance with an embodiment of the present disclosure may be able to efficiently inlet dust positioned near the surface of a wall without a separate side brush.

Figure 4:
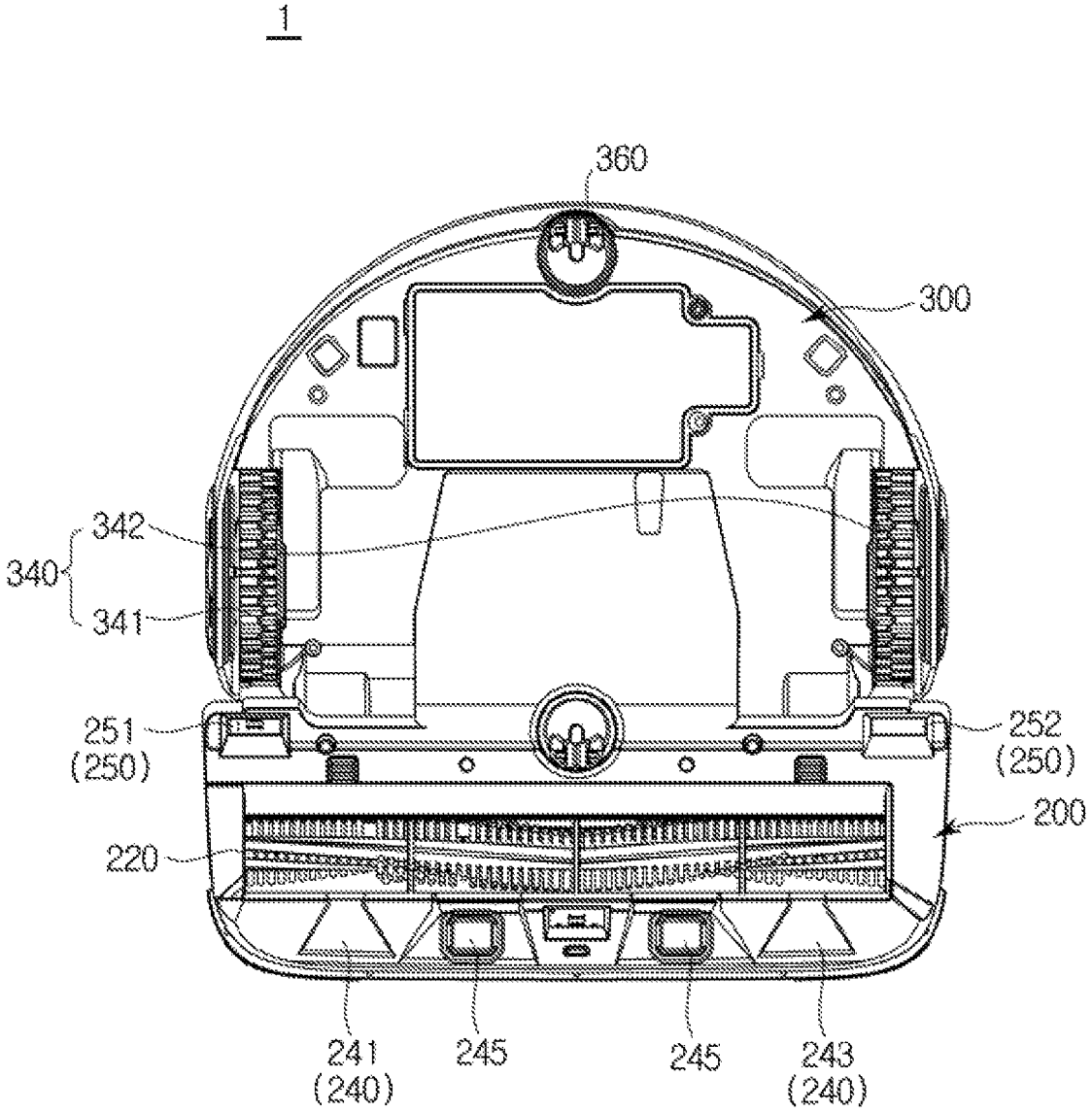
FIG. 4 is a drawing illustrating a lower surface of the autonomous cleaner in accordance with an embodiment of the present disclosure.

FIG. 4 is a drawing illustrating a lower surface of the autonomous cleaner in accordance with an embodiment of the present disclosure.

As illustrated on FIG. 4, the brush unit 220 configured to sweep and collect the dust of a floor is coupled to a lower surface of the first housing 200. At least one guide flow path 240 configured to guide dust into the brush unit 220 to increase a inlet force of the dust may be formed at a front of the brush unit 220 of the first housing 200. The descriptions of the guide flow path 240 will be described later.

A recharging terminal 245 configured to recharge the autonomous cleaner 1 may be provided between the guide flow paths 240.

A fall detecting sensor 250 provided to detect the distance with respect to a floor surface during a driving of the body may be mounted at least at a portion of the first housing 200.

The fall detecting sensor 250 is provided to set a direction at a position at which a difference in height is present during a driving of the autonomous cleaner 1. The fall detecting sensor 250 is disposed at a lower surface of the first housing 200 to face a floor, and while detecting the distance with respect to the floor surface, is configured to form a certain voltage when spaced apart by a certain distance or greater with respect to the floor surface, and then transmits information to a control unit (not shown) of the body. The control unit (not shown), by determining an estimated position at which the body may fall according to the transmitted information of the body, is provided to change the direction of driving.

In accordance with an embodiment of the present disclosure, the fall detecting sensor 250 may be provided at a rear of the brush unit 220. The fall detecting sensor 250 in accordance with an embodiment of the present disclosure is provided with two units thereof, that is, a first fall detecting sensor 251 and a second fall detecting sensor 252, but is not limited hereto.

The roller 360 rotatively provided to reduce driving load being generated when the body is driven only by use of the driving wheels 340, may be coupled to a rear surface of the second housing 300. The roller 360 may be coupled to a position at which the center of gravity of the body may be able to be supported with respect to the driving wheels 340. That is, the roller 360 may be disposed such that the distance from the roller 360 to the first driving wheel 341 and the distance from the roller 360 to the second driving wheel 342 are identical with respect to each other. From the above, the driving load being generated during a driving of the body may be minimized.

As the above, the brush unit 220, the dust collecting unit 330, and the power unit 350 may be disposed toward a longitudinal direction of the body. That is, the brush unit 220, the dust collecting unit 330, and the power unit 350 may be provided in a row toward a first direction. In accordance with an embodiment of the present disclosure, the dust collecting unit 330 and the driving unit 340 may be disposed in a lateral direction of the body.

Figure 5:
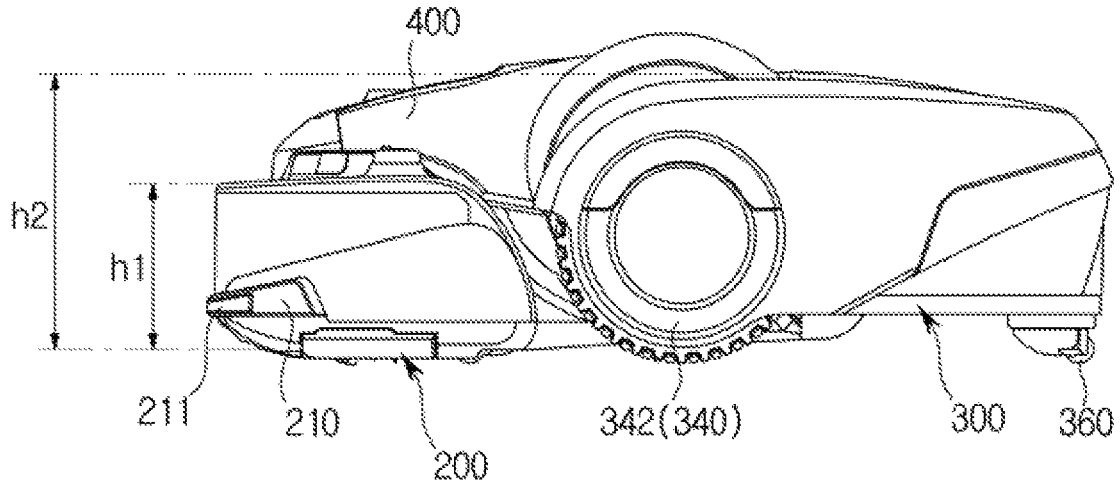
FIG. 5 is a drawing illustrating a side surface of the autonomous cleaner in accordance with an embodiment of the present disclosure.

FIG. 5 is a drawing illustrating a side surface of the autonomous cleaner in accordance with an embodiment of the present disclosure.

As illustrated on FIG. 5, the height h1 between a floor surface and an upper surface of the first housing 200 and the height h2 between the floor surface and an upper surface of the second housing 300 may be different with respect to each other. In accordance with an embodiment of the present disclosure, the height between a floor surface and an upper surface of the first housing 200 may be less than the height between the floor surface and an upper surface of the second housing 300. As the height h1 of the first housing 200 is less than the height h2 of the second housing 300, the sizes of the dust collecting container 310 and the power unit 350 positioned at the second housing 300 is increased, the size of the autonomous cleaner 1 may be seen relatively smaller. According to the above, the amount of the dust that may be stored at the miniaturized autonomous cleaner 1 may be increased, and the time of driving without additional recharging may be increased.

In addition, as the height h1 of the first housing 200 is provided to be relatively lower, the obstacle positioned at a floor surface may efficiently be detected, and thus a blind spot that may not be detected by use of the obstacle detecting sensor 230, which is to be described later, may be prevented from occurring.

In accordance with an embodiment of the present disclosure, the connecting member 400 is coupled between the first housing 200 and the second housing 300, but is not limited hereto, and the first housing 200 and the second housing 300 may be integrally injection-molded without having a separate boundary. In the case of such, the first housing 200 and the second housing 300 may be provided with the shape of an approximate streamline.

Figure 6:
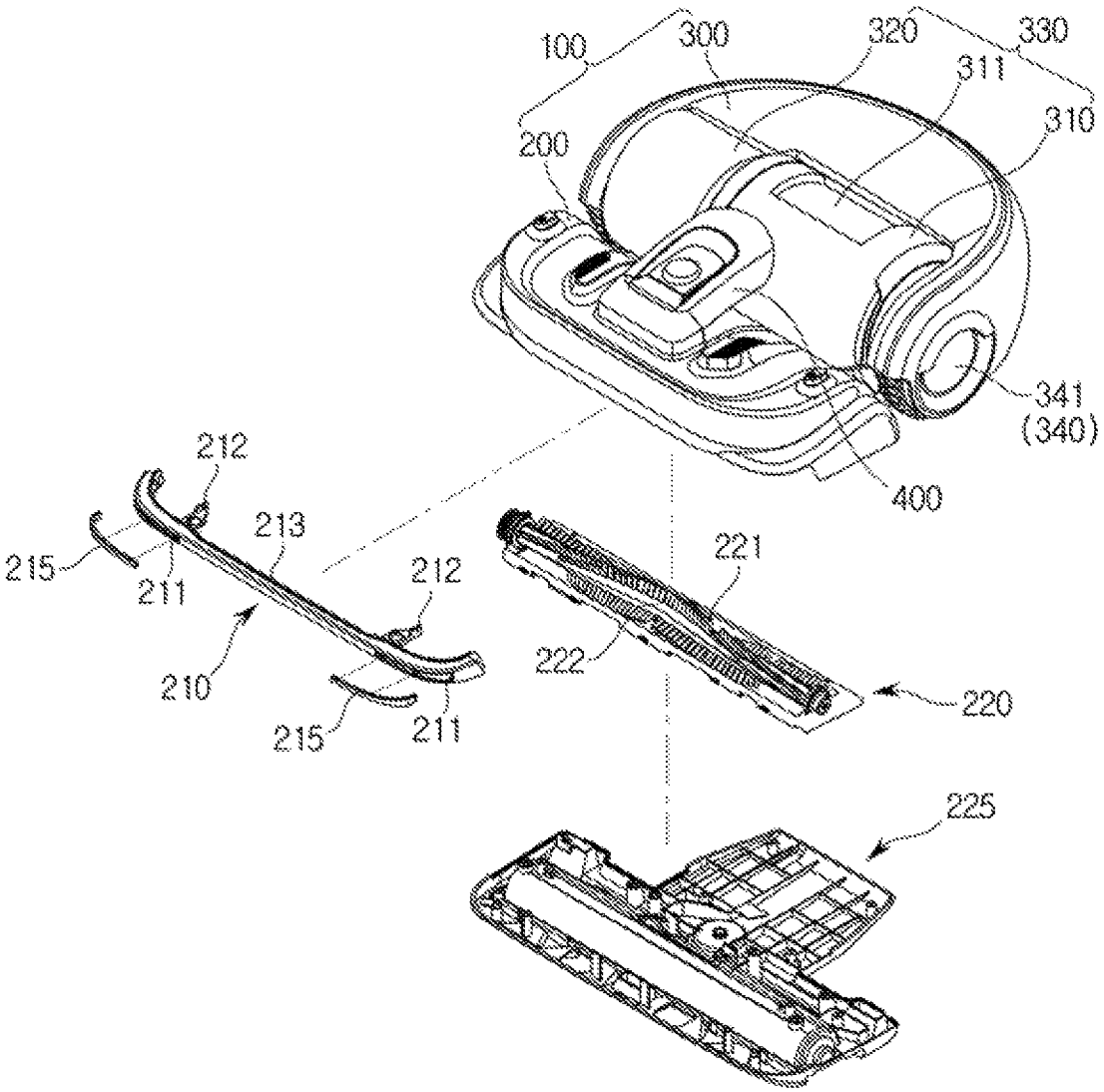
FIG. 6 is a drawing illustrating a disassembled state of structuring elements of the first housing of the autonomous cleaner in accordance with an embodiment of the present disclosure.

FIG. 6 is a drawing illustrating a disassembled state of structuring elements of the first housing of the autonomous cleaner in accordance with an embodiment of the present disclosure.

As illustrated on FIG. 6, the brush unit 220 configured to sweep and collect the dust of a floor and the bumper 210 positioned at a front of the first housing 200 may be coupled to the first housing 200. The brush unit 220 may be coupled to an opening unit 223 (FIG. 8) provided at a lower surface housing 225 positioned at a lower surface of the first housing 200.

The brush unit 220 is provided in the shape of a drum, and is structured by use of a roller unit 222 and a brush 221.

The bumper 210 is provided to surround at least a portion of a front surface unit of the first housing 200. A bumper body 213 may be extended so that the bumper 210 may be able to surround a portion of a side surface unit in addition to a portion of the front surface unit of the first housing 200.

The bumper 210 may include a bumper head 212 protruded to be coupled to the first housing 200 while extended from the bumper body 213. According to the illustration on the drawing, the bumper head 212 is provided with two units thereof, but is not limited hereto.

In addition, the separate buffer member 215 may be coupled to a front surface of the bumper 210, and a coupling groove 211 configured to couple the buffer member 215 may be provided at the bumper body 213.

FIG. 7 is a drawing illustrating a disassembled state of structuring elements of the second housing of the autonomous cleaner in accordance with an embodiment of the present disclosure.

As illustrated on FIG. 7, the driving units 340 and 360, the dust collecting unit 330, and the power unit 350 may be disposed at the second housing 300.

The second housing 300 may include an upper surface housing 303 coupled to an upper portion, and a rear surface housing 343 coupled from a rear of the second housing 200 to the driving wheels 340.

In the case of the upper surface housing 303, the area corresponding to the display unit 352 may be provided to be open so the state being displayed at the display unit 352 may be projected. The dust collecting container 310 may be coupled to the upper surface housing 303. A separate outer side housing 301 coupled to an upper portion of the power unit 350 may be coupled to an outer side of the upper surface housing 303. The outer side housing 201 may be provided such that the state of the display unit 352 may be projected.

In addition, the inlet motor housing 302 may be coupled to an upper portion of the inlet motor 320. The inlet motor 320 is coupled to the second housing 300, the upper portion housing 303 is inserted into the second housing 300, and the inlet motor 320 may be coupled to the upper portion housing 303. In accordance with an embodiment of the present disclosure, as the outer side housing 301 is provided not to surround the area at which the inlet motor 320 is positioned, the inlet motor housing 302 is coupled to prevent foreign substance from being intruded into the inlet motor 320.

The rear surface housing 343 may be coupled to surround the each of the driving wheels 341 and 342, after the first driving wheel 341 and the second driving wheel 342 are coupled to the both sides of the second housing 300.

As the above, in accordance with an embodiment of the present disclosure, space may be efficiently used by efficiently disposing the structuring elements of the autonomous cleaner. According to the above, the size of the dust collecting container 310 may be increased, and the space occupied by the power unit 350 may be increased, so that the capacity of the battery (not shown) may be increased. From the above, the capacity of the battery may be increased by about 3 times when compared to the autonomous cleaner 1 of the similar size, and thus the driving time of the autonomous cleaner 1 configured to be used without recharging may be increased.

Figure 8:
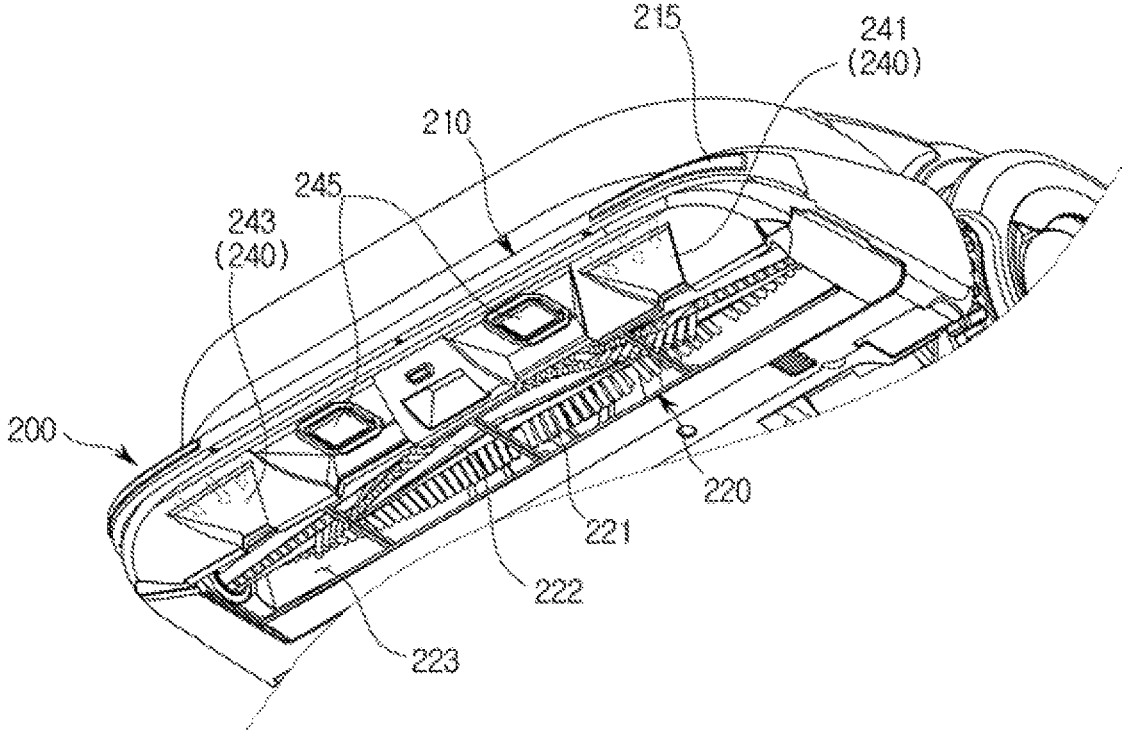
FIG. 8 is a drawing illustrating a lower surface of the first housing of the autonomous cleaner in accordance with an embodiment of the present disclosure.

FIG. 8 is a drawing illustrating a lower surface of the first housing of the autonomous cleaner in accordance with an embodiment of the present disclosure.

As illustrated on FIG. 8, the guide flow path 240 may be provided at a front of the brush unit 220. The guide flow path 240 provided at a lower surface of the first housing 200 is configured to guide to have dust inlet.

The guide flow path 240 may be concavely provided with respect to the lower surface of the first housing 200. The guide flow path 240 is provided with a width thereof narrowed toward a direction of the brush unit 220 so that the inletting of dust into the brush unit 220 may be guided.

In accordance with an embodiment of the present disclosure, the guide flow path 240 is provided with flow units thereof at both sides of the lower surface of the first housing 200, and includes a first guide flow path 241 and a second guide flow path 243, but is not limited hereto.

The guide flow path 240 may be able to guide the inlet of dust toward the direction of the arrow illustrated on the drawing.

Figure 9:
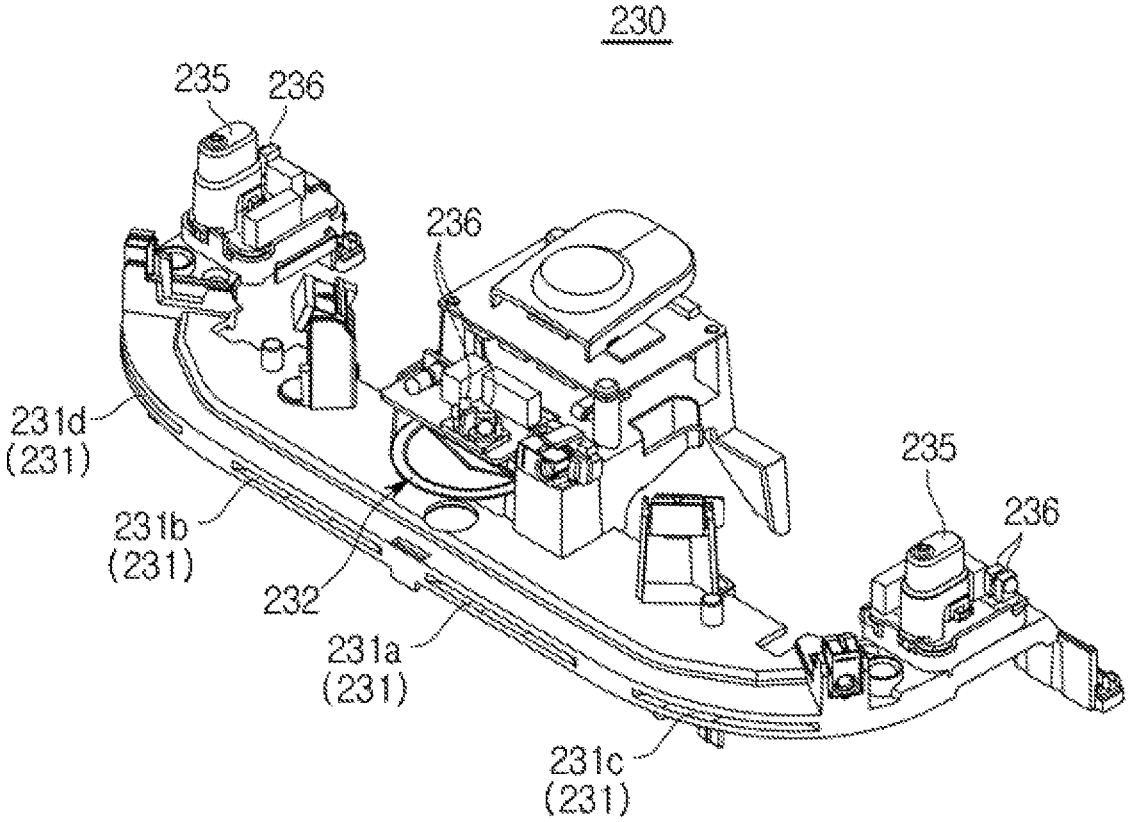
FIG. 9 is a drawing illustrating an obstacle detecting sensor of the autonomous cleaner in accordance with an embodiment of the present disclosure.
Figure 10:
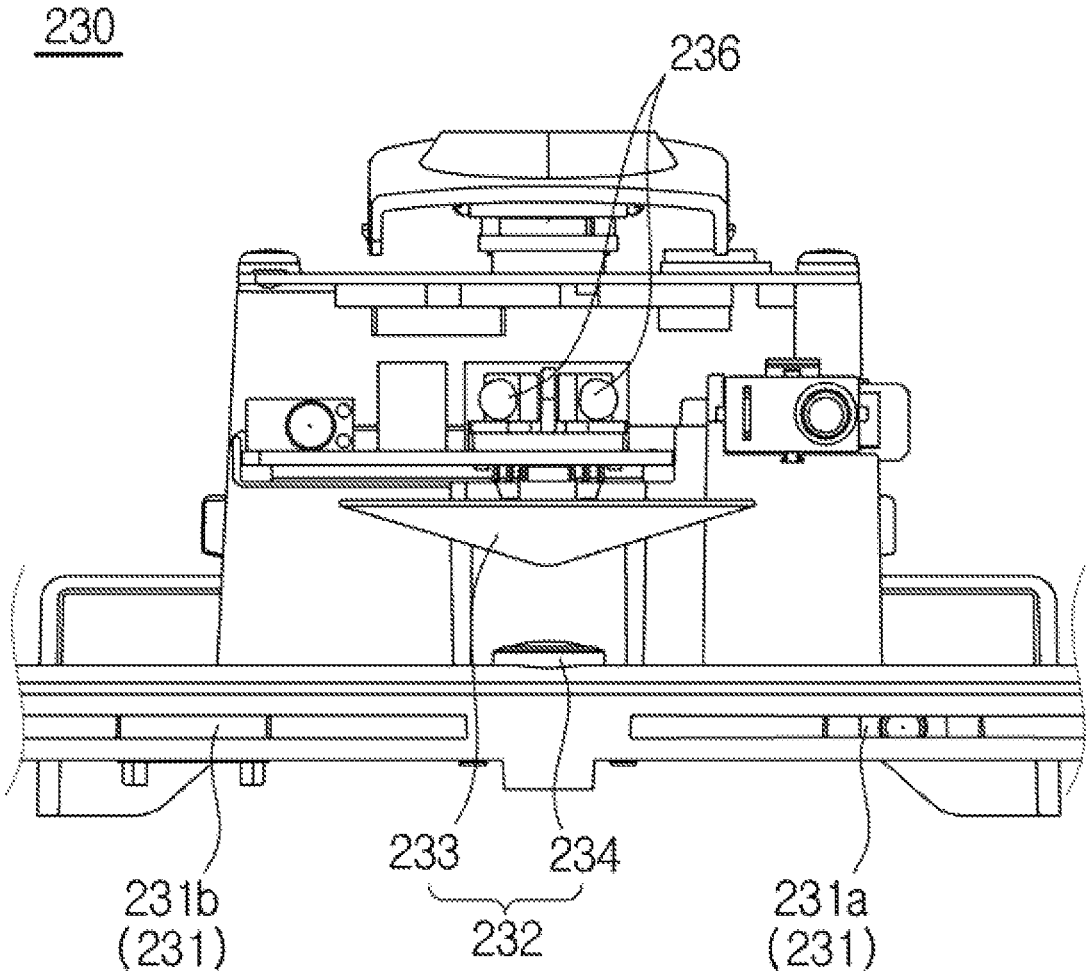
FIG. 10 is a drawing illustrating the obstacle detecting sensor illustrated on FIG. 9 from a different angle.

FIG. 9 is a drawing illustrating the obstacle detecting sensor of the autonomous cleaner in accordance with an embodiment of the present disclosure, and FIG. 10 is a drawing illustrating the obstacle detecting sensor illustrated on FIG. 9 from a different angle.

As illustrated on FIG. 9 and FIG. 10, the obstacle detecting sensor 230 configured to detect obstacles to avoid the obstacles may be mounted inside the first housing 200.

An infrared light sensor or an ultrasound wave sensor may be applied to the obstacle detecting sensor 230. In accordance with an embodiment of the present disclosure, the obstacle detecting sensor 230 is positioned at a front of the first housing 200, but is not limited hereto, and may be positioned at a side surface, for example.

The obstacle detecting sensor 230 is configured to detect obstacles or walls in a driving direction of the autonomous cleaner 1, and, by detecting distance with respect to the detected obstacles or walls, transmit the detected distance to a control unit (not shown) inside the body. The control unit (not shown), when an obstacle detecting signal is received from the obstacle detecting sensor 230, is provided to control the driving units 340 and 360 so that the body may not drive toward a front direction or a driving direction.

The obstacle detecting sensor 230 may include at least one light emitting unit 231 to scatter and emit light into flat light, and a light receiving unit 232 to generate electrical image signals by receiving the flat light reflected from an obstacle.

In accordance with an embodiment of the present disclosure, the light emitting unit 231 may be provided at a front of the light receiving unit 232. The light emitting unit 231 may be positioned at an inner side of the obstacle detecting sensor housing. In accordance with an embodiment of the present disclosure, the light emitting unit 231 may be provided with 4 units thereof, that is, light emitting units 231*a*, 231*b*, 231*c*, and 231*d*, and the light emitting units 231*a*, 231*b*, 231*c*, and 231*d* may be provided at a predetermined distance from each other. The height of the obstacle detecting sensor 230 may be lowered by disposing the light emitting unit 231 at a front of the light receiving unit 232, and in the case as such, the light receiving unit 232 may be disposed higher than the light emitting unit 231. According to the above, even when the light emitting unit 231 is disposed at the front of the light receiving unit 232, the flat light reflected and returned from the obstacle is not blocked by the light emitting unit 231 and may be entirely transmitted to the light receiving unit 232. In addition, as the height of the obstacle detecting sensor 230 may be lowered, the height of the first housing 200 may be lowered, and the autonomous cleaner 1 may be miniaturized.

The light receiving unit 232 includes a reflective mirror 233 configured to change the path of reflective light so that the reflective light being reflected may be directed toward an image sensor 234, an optical lens (not shown) to collect the reflective light having the path thereof changed by use of the reflective mirror 233, and the image sensor 234 to receive the reflective light collected by use of the optical lens (not shown).

The reflective mirror 233 may employ a conical mirror to change the paths of the reflective light being incident from various directions toward the image sensor 234. In addition, the reflective mirror 233 is installed at an upper portion of the image sensor 234, and may be vertically disposed toward a lower direction so that the peak of the reflective mirror 233 having the shape of a cone may face the image sensor 234. In addition, although not illustrated on the drawing, the reflective mirror 233 having the shape of a cone may be installed at a lower portion of the image sensor 234, and the image sensor 234 may be vertically disposed at toward an upper direction so that the peak of the reflective mirror 233 having the shape of a cone may face the image sensor 234. However, the shape of the reflective mirror 233 is not limited to the shape of a cone.

The entry blocking sensor 235 may be positioned at both sides of the obstacle detecting sensor housing.

In addition, in accordance with an embodiment of the present disclosure, a remote control receiving sensor 236 configured to receive signals transmitted from a remote control (not shown) may be positioned. In accordance with an embodiment of the present disclosure, the remote control receiving sensor 236 may be provided with the total of 8 units thereof.

In accordance with an embodiment of the present disclosure, the two units of the remote control receiving sensor 236 are provided at an upper portion of the light receiving unit 232, and the two units of the remote control receiving sensor 236 may be provided to be adjacent with respect to the each of the two units of the entry blocking sensor 235. In addition, the two units of the remote control receiving sensor 236 are further provided at a rear surface of the body, so that the total of the eight units of the remote control receiving sensor 236 may be provided.

Figure 11:
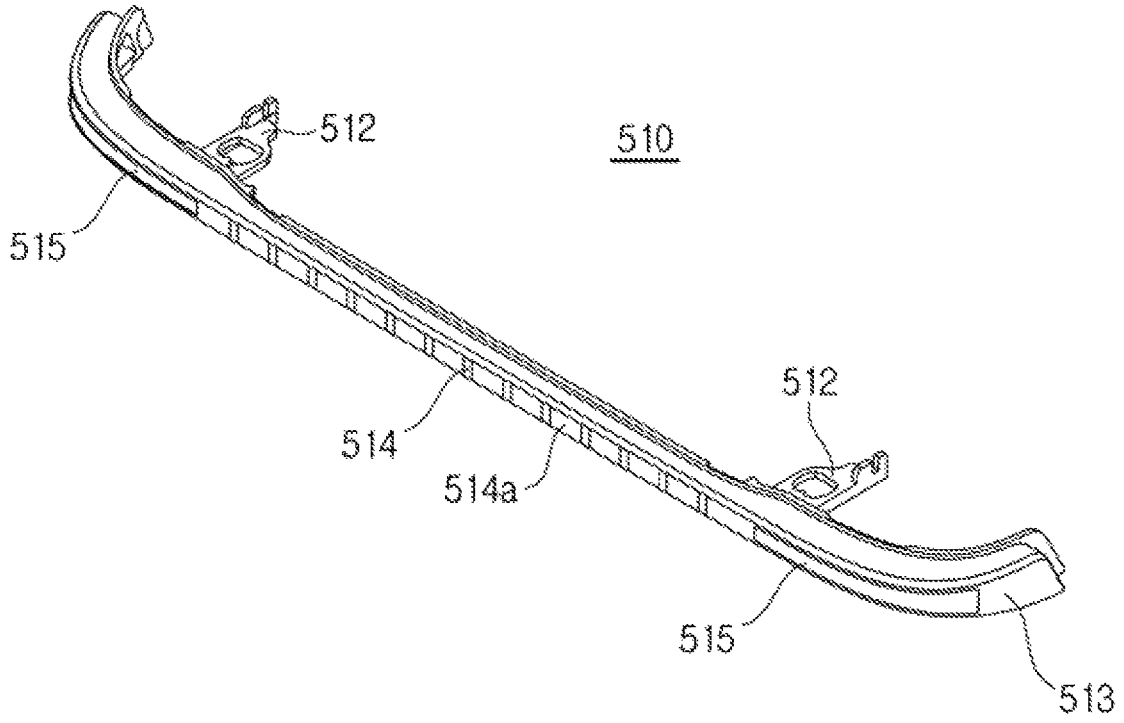
FIG. 11 is a drawing illustrating a disassembled bumper in accordance with an embodiment of the present disclosure.

FIG. 11 is a drawing illustrating a disassembled bumper in accordance with an embodiment of the present disclosure.

As illustrated on FIG. 11, in accordance with an embodiment of the present disclosure, a bumper 510 may include a bumper body 513 and a bumper head 512. A plurality of ribs 514 may be provided at a front surface of the bumper body 513. According to the above, a groove 514*a* may be provided between the ribs 514. An inlet flow path may be formed to have dust inlet into the brush unit 220 and stored at the dust collecting container 310 when the body is near a wall by use of the ribs 514. In addition, a separate buffer member 515 may be coupled to the bumper 510. According to the above, the dust on a floor surface may be efficiently removed.

Hereinafter, with respect to describing FIG. 12 to FIG. 21, the descriptions from FIG. 1 to FIG. 11 will be cited within the scope that the descriptions are not in conflict with respect to each other.

Figure 12:
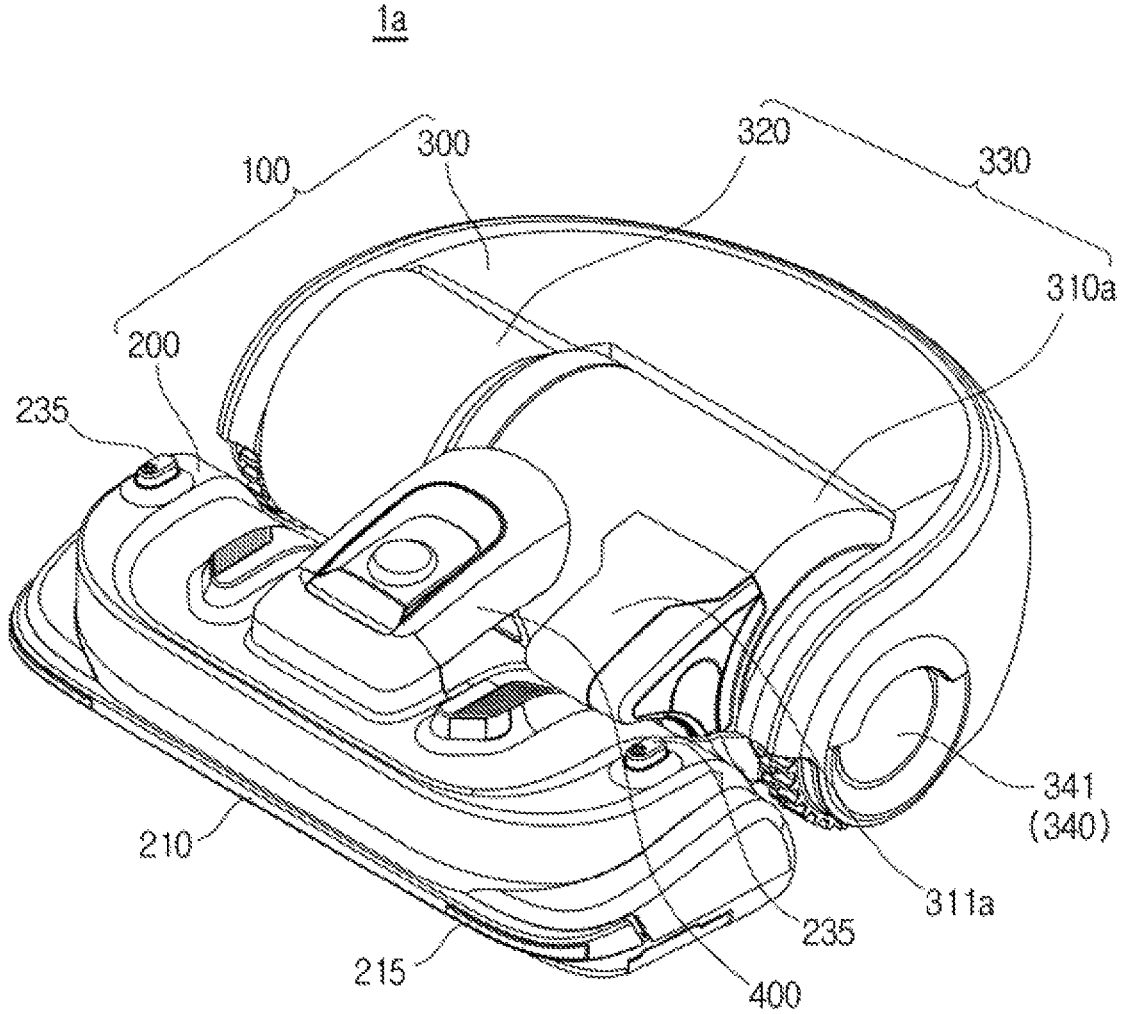
FIG. 12 is a perspective view illustrating an exterior appearance of an autonomous cleaner in accordance with an embodiment of the present disclosure.
Figure 13:
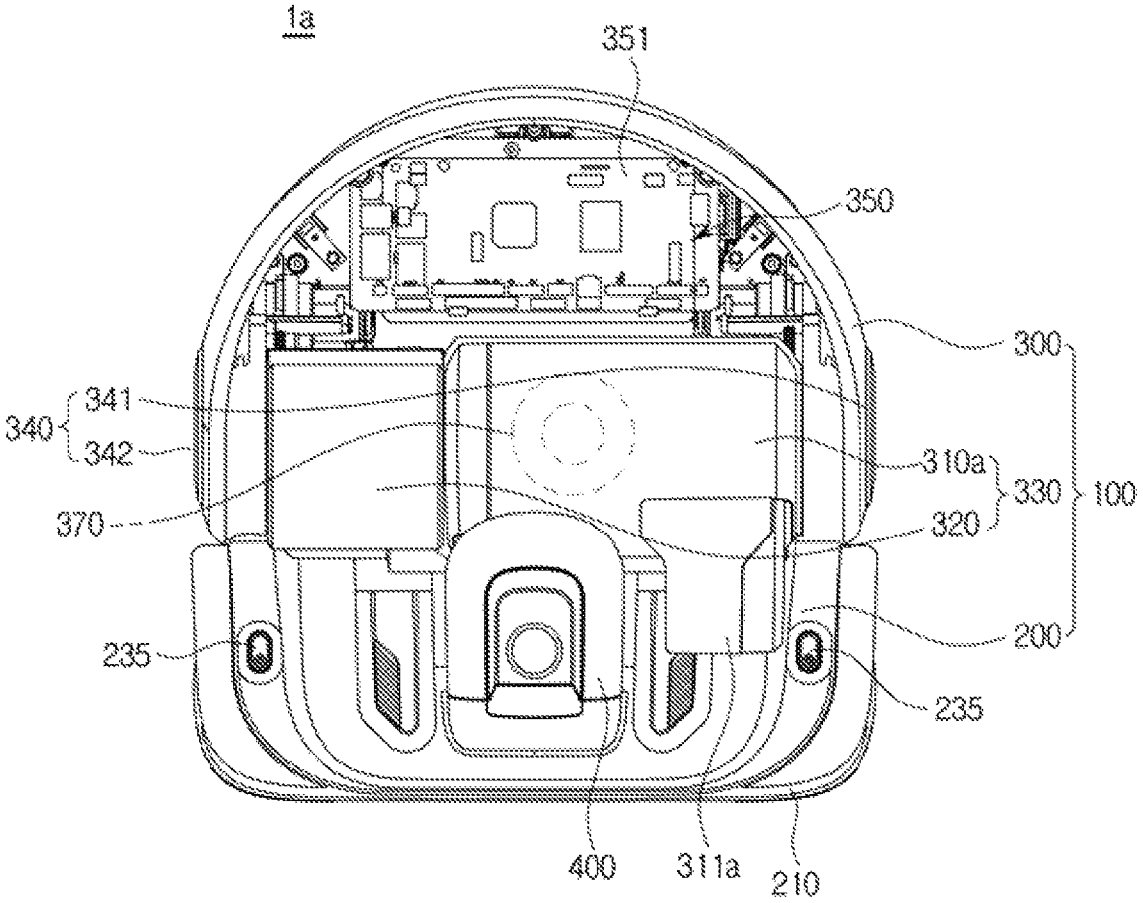
FIG. 13 is a plane view illustrating a state of an outer housing of a second housing of the autonomous cleaner removed in accordance with an embodiment of the present disclosure.

FIG. 12 is a perspective view illustrating an exterior appearance of an autonomous cleaner 1*a* in accordance with an embodiment of the present disclosure, and FIG. 13 is a plane view illustrating a state of an outer housing of a second housing of the autonomous cleaner removed in accordance with an embodiment of the present disclosure.

As described earlier, the dust collecting unit 330 may include a dust collecting container 310*a* to store the inlet dust. A gripping unit 311*a* provided for a user to grip may be provided at the dust collecting container 310*a*. The user may be able to separate the dust collecting container 310*a* from the second housing 300 by gripping the gripping unit 311*a* to rotate the dust collecting container 310*a*. The user may be able to remove the accumulated dust inside the dust collecting container 310*a* by separating the dust collecting container 310*a*.

A cyclone structure 370 may be installed inside the dust collecting container 310*a*. As illustrated on FIG. 13, the cyclone structure 370 may be disposed inside the dust collecting container 310 that is adjacent with respect to the inlet motor 320.

Figure 14:
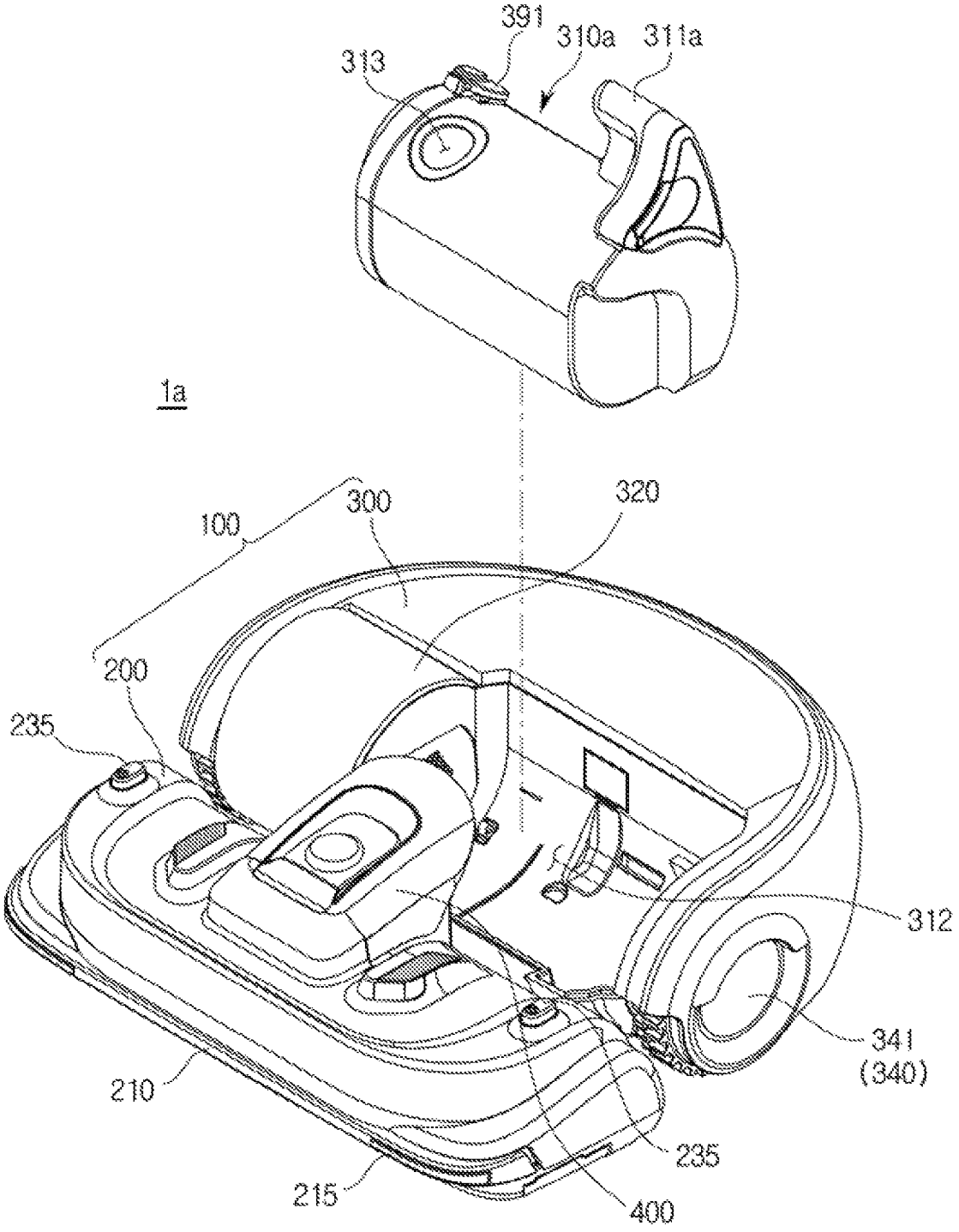
FIG. 14 is a drawing illustrating a state of a dust collecting container of the autonomous cleaner in accordance with an embodiment of the present disclosure rotated and separated.

FIG. 14 is a drawing illustrating a state of the dust collecting container of the autonomous cleaner in accordance with an embodiment of the present disclosure rotated and separated.

As described earlier, the dust collecting unit 330 is coupled to the second housing 300, and the dust collecting unit 330 may include the dust collecting container 310*a*, and the inlet motor 320 disposed at one side of the dust collecting container 310*a*.

The second housing 300 may include the dust collecting container installation unit 312 at which the dust collecting container 310*a* is installed. The dust collecting container 310*a* may be installed at the dust collecting container installation unit 312 such that at least a portion of the dust collecting container 310*a* is exposed as an exterior appearance. The exterior appearance of the dust collecting container 310*a* may be provided with transparent material so that a user may be able to directly view the amount of the accumulated dust. In addition, the dust collecting container 310*a* may be detachably coupled to the dust collecting container installation unit 312 so that a user may be able to remove the accumulated dust.

The dust collecting container 310*a* may include an inlet unit 313 and an outlet unit 314 (FIG. 14). The inlet unit 313 is provided toward a front surface of the body, and may be connected to the first housing 200. Thus, the air having the dust entering inside the first housing 200 through the opening unit 223 positioned at a lower surface of the first housing 200 may be inlet to an inside of the dust collecting container 310*a* through the inlet unit 313.

As illustrated on FIG. 14, the dust collecting container 310*a* may be provided in the shape of a cylinder. In addition, the dust collecting container installation unit 312 may be provided in the shape of a cylinder corresponding to the shape of the dust collecting container 310*a*. According to the above, the dust collecting unit 310*a* may be rotatively installed with respect to the dust collecting container installation unit 312.

As illustrated on FIG. 12, the dust collecting container 310*a* may be installed at the dust collecting container installation unit 312 such that the gripping unit 311*a* may face a front surface. A user, by gripping the gripping unit 311*a* and rotating the gripping unit 311 toward an upper portion direction, may be able to separate the dust collecting container 310*a* from the dust collecting container installation unit 312. At this time, according to the rotation of the dust collecting container 310*a*, the inlet unit 313 is faced toward an upper portion, and foreign substance such as accumulated dust at the surroundings of the inlet unit 313 may not fall outside the dust collecting container 310*a*.

Figure 15:
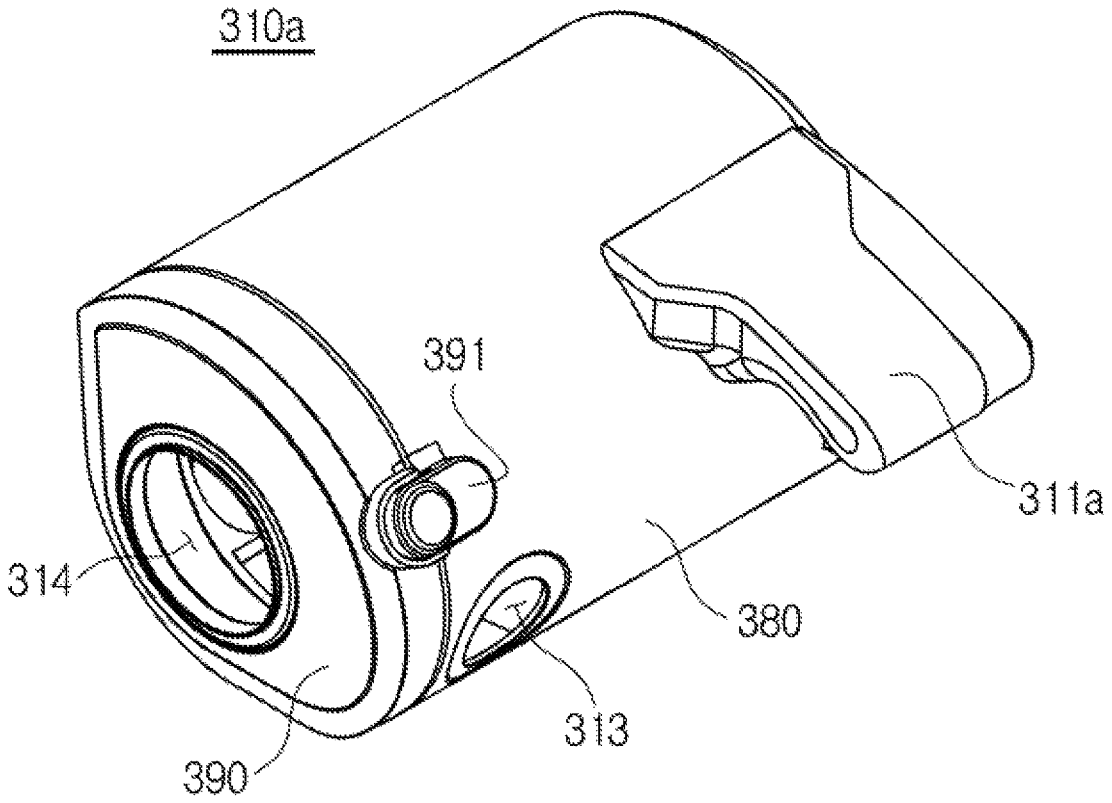
FIG. 15 is a drawing illustrating the dust collecting container of the autonomous cleaner in accordance with an embodiment of the present disclosure.

FIG. 15 is a drawing illustrating the dust collecting container 310*a* of the autonomous cleaner in accordance with an embodiment of the present disclosure.

As described earlier, the dust collecting container 310*a* may include the inlet unit 313 and the outlet unit 314. The inlet unit 313 is provided toward a front surface of the body, and the outlet unit 314 may be provided toward the inlet motor 320. The air having the dust inlet inside the dust collecting container 310*a* through the inlet unit 313 is separated from the dust by use of the cyclone structure 370. The air having been removed from the dust as such is released from a dust collecting container 320*a* through the outlet unit 314 and may move to the inlet motor 320.

The dust collecting container 320*a* may include a dust collecting member 380 to store separated dust, and a cover member 390 coupled to one side of the dust collecting member 380. The dust collecting member 380 and the cover member 390 may be detachably coupled. For example, the dust collecting member 380 and the cover member 390 each may include one of a first hook 391 and a first accommodation groove 381 (FIG. 16) provided to correspond to the first hook 391, and may be hook-coupled.

Figure 16:
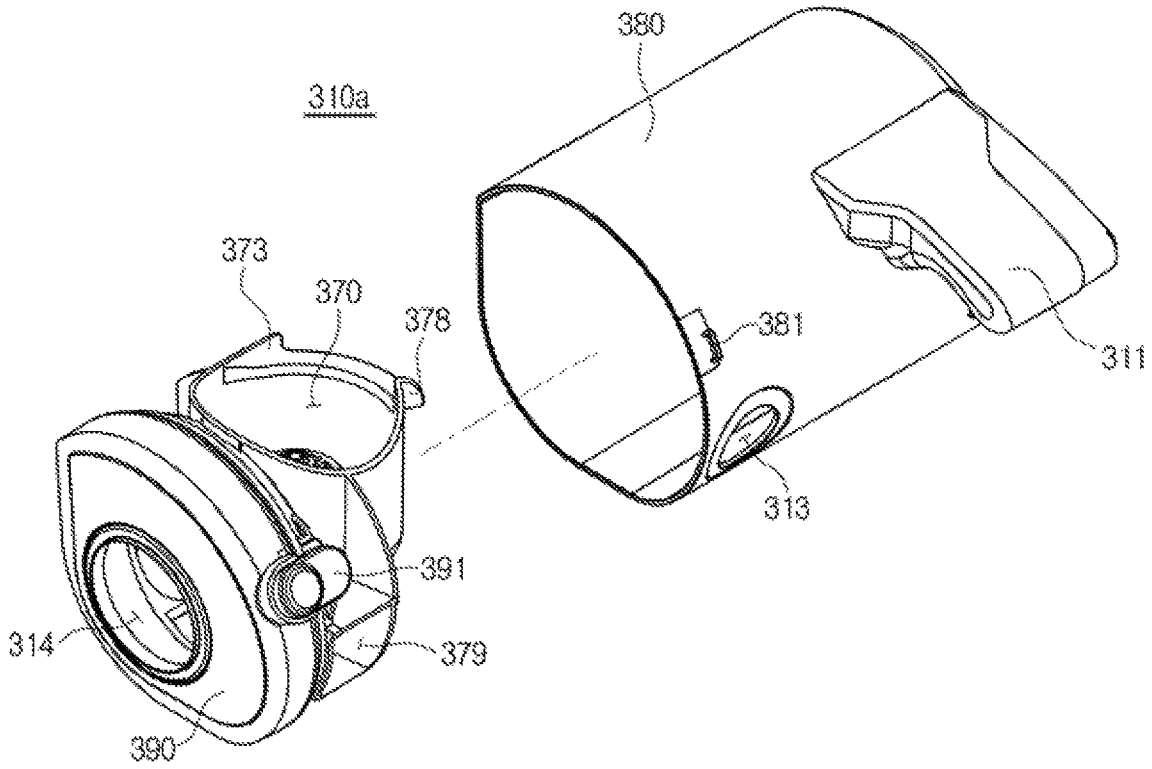
FIG. 16 is a drawing illustrating a disassembled state of the dust collecting container of the autonomous cleaner in accordance with an embodiment of the present disclosure.

FIG. 16 is a drawing illustrating a disassembled state of the dust collecting container of the autonomous cleaner in accordance with an embodiment of the present disclosure.

On FIG. 16, the first hook 391 provided at the cover unit 390 and the first accommodation groove 381 provided at the dust collecting member 380 are illustrated. The first hook 391 is rotatively provided at a predetermined angle by use of a pressure of one side, and the other side may be provided to be coupled to the first accommodation groove 381. Thus, the first hook 391 may be separated from the first accommodation groove 381 by pressing one side of the first hook 391. A user may be able to press one side of the first hook 391 at the dust collecting container 310 illustrated on FIG. 12 to separate the dust collecting member 380 and the cover member 390 as shown on FIG. 16.

The cover member 390 may be coupled to one side of the dust collecting member 380 that is adjacent to the inlet motor 320. That is, the inlet motor 320, the cover member 390, and the dust collecting member 380 may be disposed in order toward a single direction.

The cyclone structure 370 may be disposed inside the dust collecting container 310 to be connected to the inlet unit 313 and the outlet unit 314. The cyclone structure 370 may include an inlet flow path 379 connected to the inlet unit 313. That is, the cyclone structure 370 may be able to form a flow path so that the air entered through the inlet unit 313 may exit through the outlet unit 314. As illustrated on FIG. 13, the cyclone structure 370 may be adjacently positioned with respect to the inlet motor 320.

The cover member 390 and the cyclone structure 370 may be detachably coupled. For example, the cover member 390 and the cyclone structure 370 each may include one of a second hook 376 and a second accommodation groove 392 provided to correspond to the second hook 376, and may be hook-coupled.

Figure 17:
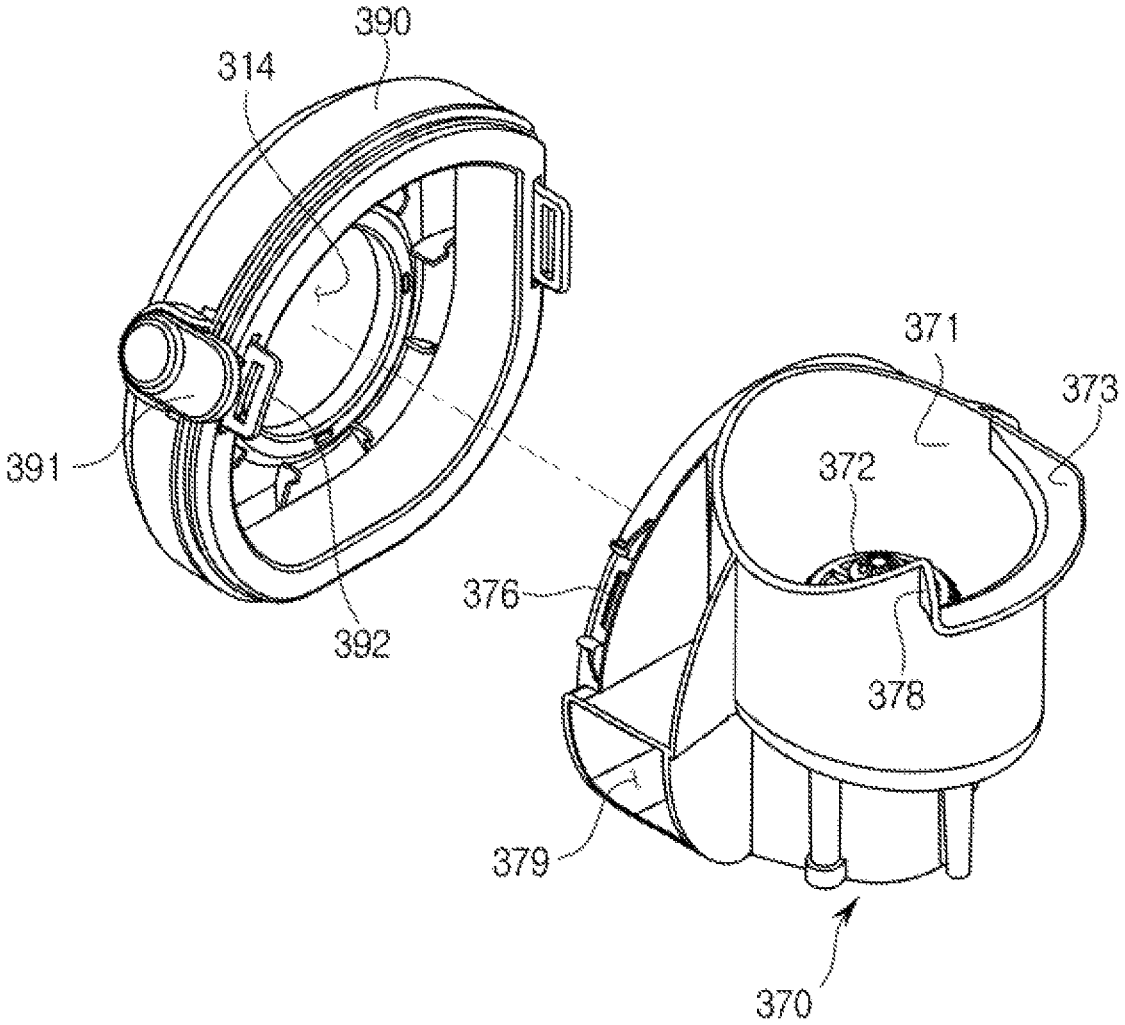
FIG. 17 is a drawing illustrating a separated state of a cover member and a cyclone structure of the autonomous cleaner in accordance with an embodiment of the present disclosure.

FIG. 17 is a drawing illustrating a separated state of the cover member and the cyclone structure of the autonomous cleaner in accordance with an embodiment of the present disclosure.

On FIG. 17, the second hook 376 provided at the cyclone structure 370 and the second accommodation groove 392 provided at the cover member 390 are illustrated. The second accommodation groove 392 may be provided with elastic material, and the cyclone structure 370 and the cover member 390 may be separated by deforming the second accommodation groove 392. The second hook 376 and the second accommodation groove 392 may be provided at both sides of the cyclone structure 370 and the cover member 390, respectively.

A filter (not shown) may be provided between the cyclone structure 370 and the cover member 390. Thus, a user may be able to remove the collected dust by separating the cover member 390 and the dust collecting member 380, and the filter (not shown) may be replaced or washed by separating the cover member 390 and the cyclone structure 370.

Figure 18:
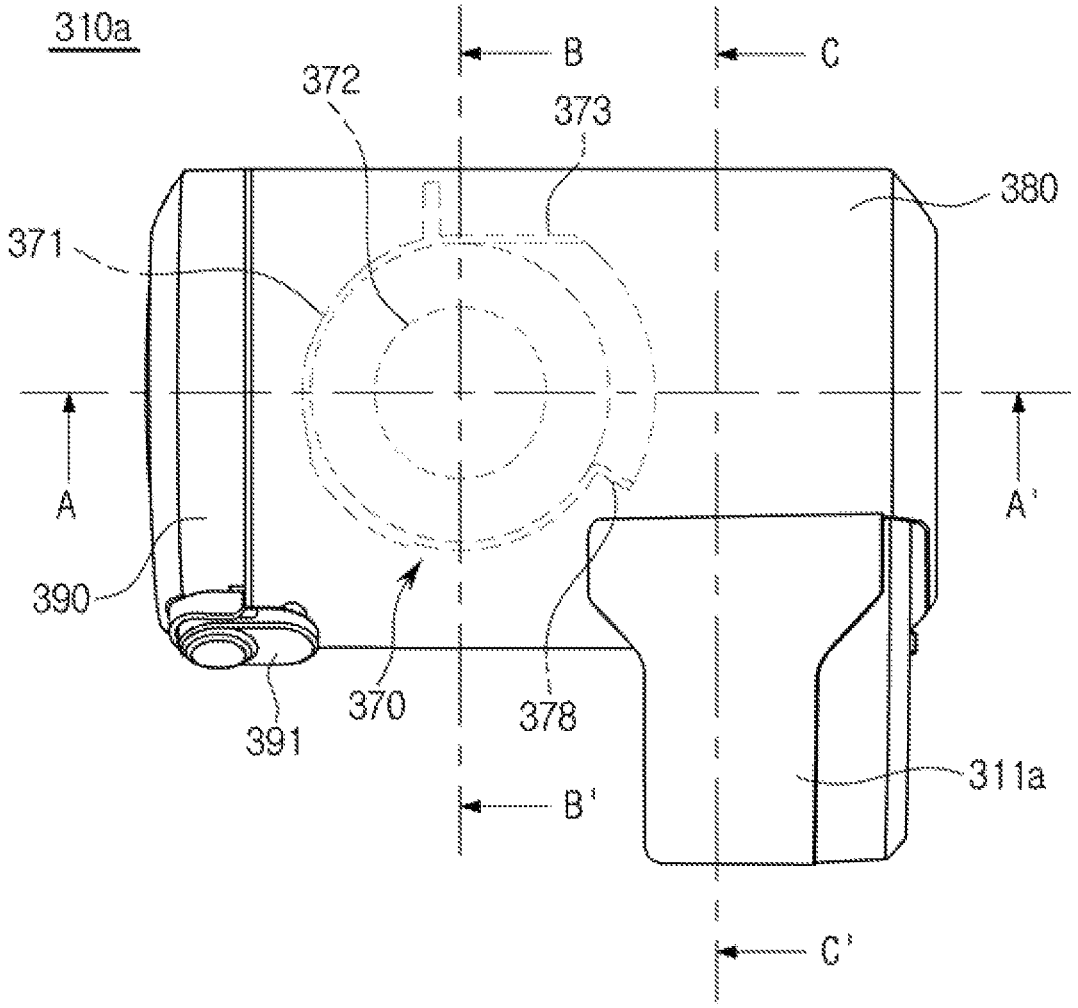
FIG. 18 is a drawing illustrating an upper surface of the dust collecting container of the autonomous cleaner in accordance with an embodiment of the present disclosure.
Figure 19:
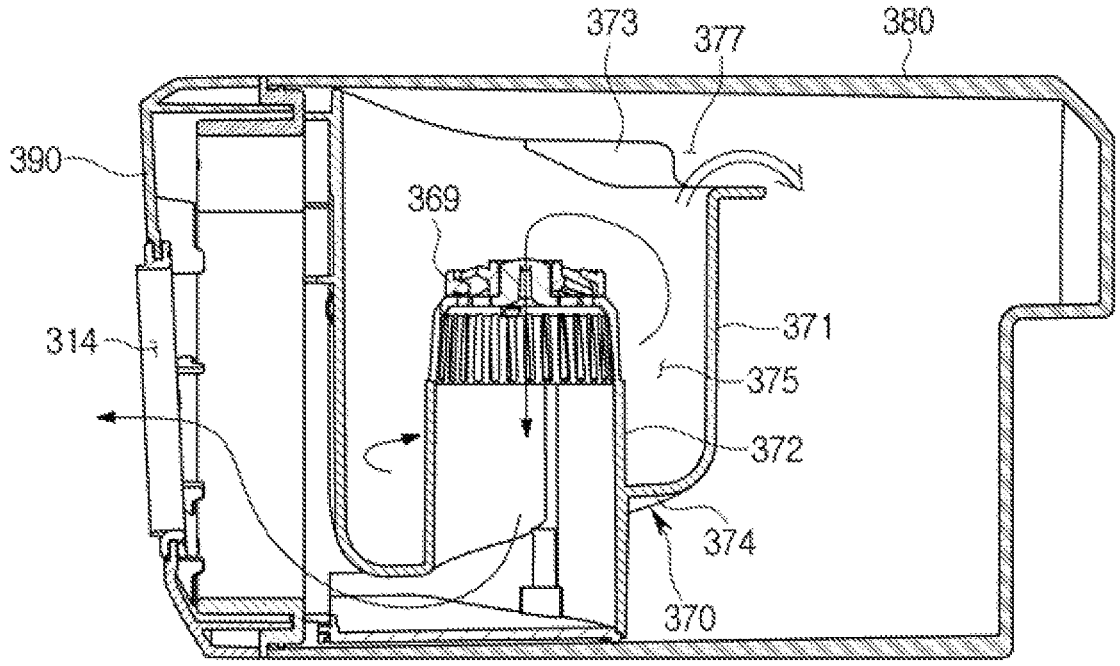
FIG. 19 is a drawing illustrating a cross section of an A-A' of FIG. 18.

FIG. 18 is a drawing illustrating an upper surface of the dust collecting container of the autonomous cleaner in accordance with an embodiment of the present disclosure, and FIG. 19 is a drawing illustrating a cross section of an A-A' of FIG. 18.

The cyclone structure 370 may be provided at an inside the dust collecting container 310*a* to centrifugally separate dust from the air having the dust that is inlet into the dust collecting container 310*a*. As described earlier, the cyclone structure 370 may be positioned at one side of an inside the dust collecting container 310*a* that is adjacent to the inlet motor 320.

The cyclone structure 370 may include an outer container 371, and an inner container 372 disposed inside the outer container 371. A rotating flow path 375*b* may be provided in between the outer container 371 and the inner container 372. In addition, the cyclone structure 370 may include a lower surface 375 configured to direct the flow of the air moving at the rotating flow path 375 in the shape of a spiral. The air having the dust inlet through the inlet unit 313 is passed through the rotating flow path 375 to be centrifugally separated from the dust. At this time, the rotating axis of the rotating flow path 375 may be perpendicularly disposed with respect to a floor surface.

Brief descriptions with respect to a centrifugal separation process will be provided. The air having the dust entered to an inside the dust collecting container 310*a* through the inlet unit 313 is entered at the rotating flow path 375 through the inlet flow path 379. The air is ascended while rotating by following the inlet flow path 375 formed in the shape of a spiral, and is separated from the dust. The dust is ascended along an inner side surface of the outer container 371 by use of a centrifugal force, and may be moved to the dust collecting member 380.

The air may be descended after entering to an inner side of the inner container 372 through an opening unit provided at an upper portion of the inner container 372. The descended air may be able to exit to the outlet unit 314 after passing through the cover member 390 through a lower portion of the lower surface 374. At this time, opening units having various shapes and numbers may be provided at an upper portion of the inner container 372 to pass the air through. In addition, a current guiding member 369 configured to assist the formation of current of air may be provided at an upper end of the inner container 372. The current guiding member 369 may be settled at an upper end of the inner container 372 while manufactured as a separate member with respect to the inner container 372. In addition, the current guiding member 369 may be provided in the shape of an impeller.

In addition, the cyclone structure 370 may include guide units 373 and 378 provided to have the separated air exit a side of the cyclone structure 370. The guide units 373 and 378 may be integrally formed with respect to the outer container 371 to guide the centrifugally separated dust toward one side of the dust collecting member 380. In addition, the guide units 373 and 378 may be provided such that the centrifugally separated dust may be moved toward an opposite direction with respect to the inlet motor 320.

As illustrated on FIG. 18, the guide units 373 and 378 may include a first guide unit 373 and a second guide unit 378 forming a dust collecting path 377 through which dust is moved. The first guide unit 373 and the second guide unit 378 may be formed at a predetermined angle. On FIG. 15, for example, the first guide unit 373 is provided toward a horizontal direction, and the second guide unit 378 is provided toward an inclined direction by about 120° with respect to a perpendicular direction.

Figure 20:
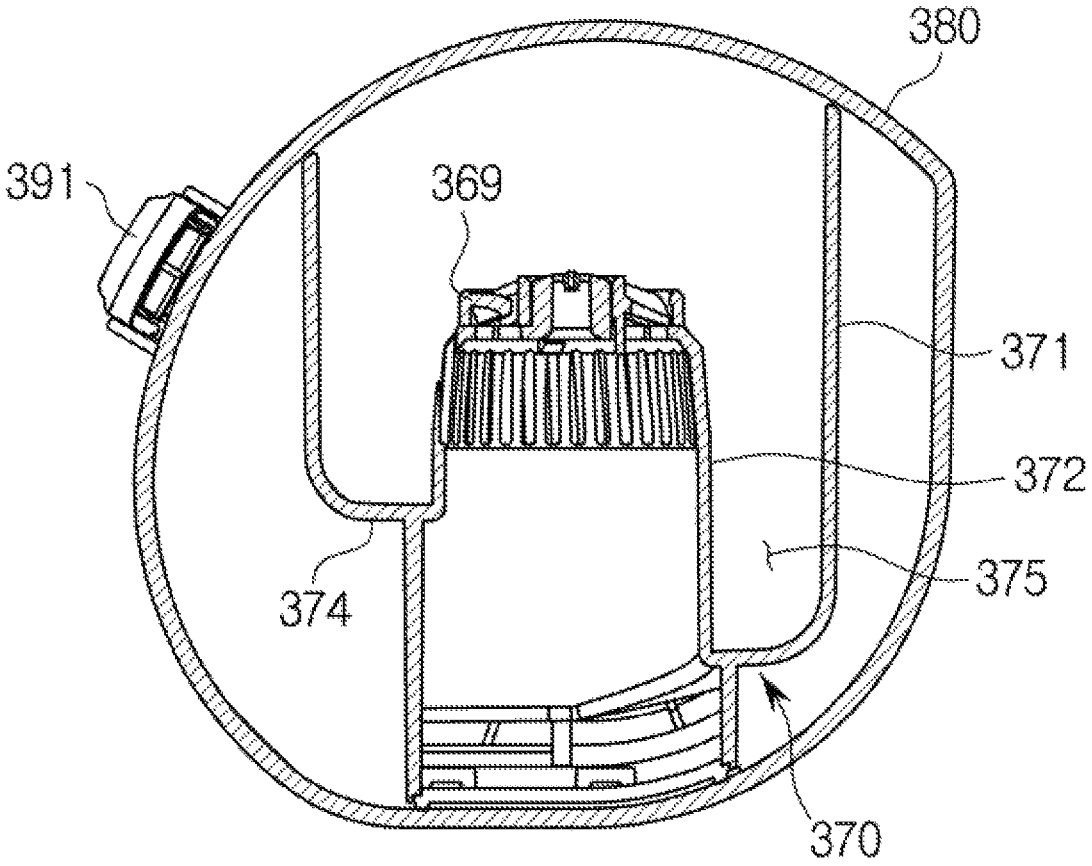
FIG. 20 is a drawing illustrating a cross section of a B-B' of FIG. 18.
Figure 21:
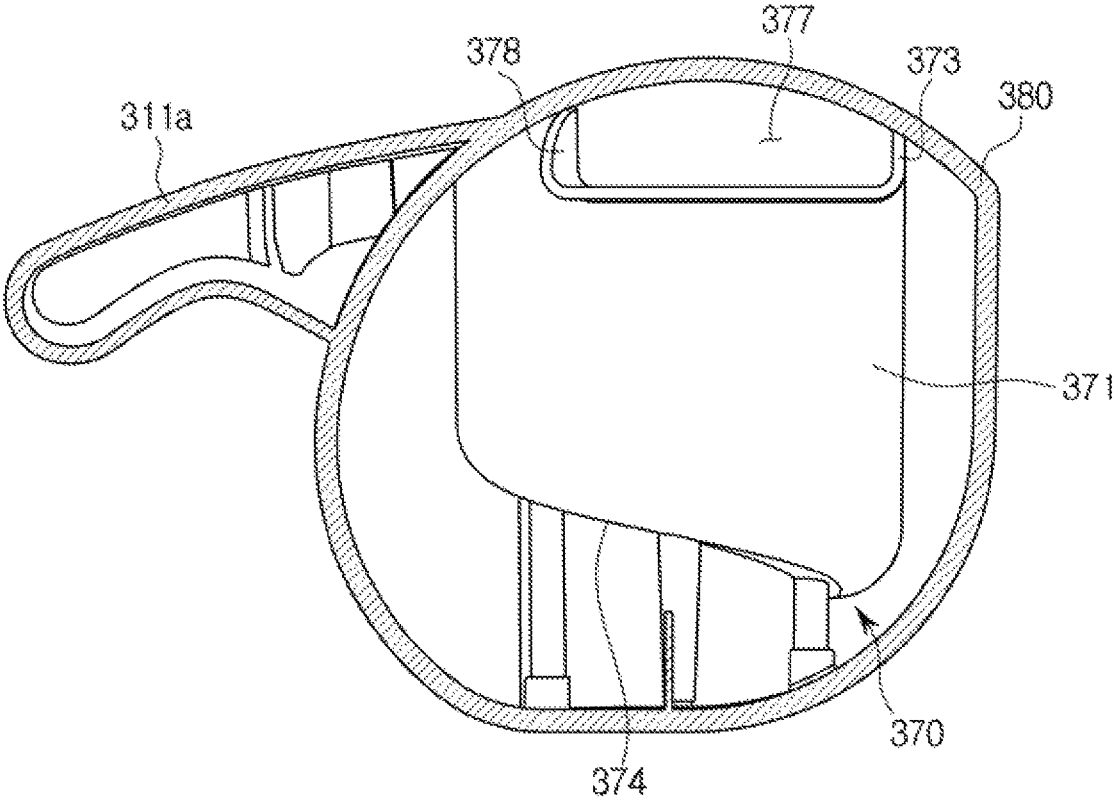
FIG. 21 is a drawing illustrating a cross section of a C-C' of FIG. 18.

FIG. 20 is a drawing illustrating a cross section of a B-B' of FIG. 18, and FIG. 21 is a drawing illustrating a cross section of a C-C' of FIG. 18.

Excluding the dust collecting path 377 formed by use of the first guide unit 373 and the second guide unit 378, the outer container 371 may be provided to be in contact with respect to an inner surface of the dust collecting member 380. That is, at least a portion of the outer container 371 may be extendedly formed to be in contact with respect to the inner surface of the dust collecting member 380. However, by tolerance during an assembly, a predetermined space may be formed at an inner surface of the dust collecting member 380 and at an upper end of the outer container 371.

As illustrated on FIG. 20, the upper end of the outer container 371 is provided to be in contact with respect to the inner surface of the dust collecting member 380. Thus, the dust ascending along the inner side surface of the outer container 371 may not be able to exit to the dust collecting member 380 along the inner side surface of the outer container 371. As illustrated on FIG. 21, the dust collecting path 377 is formed by use of the first guide unit 373 and the second guide unit 378, and the centrifugally separated dust may be able to be moved through the dust collecting path 377.

The above is provided such that the centrifugally separated dust by use of the cyclone structure 370 provided at one side inside the dust collecting container 310*a* may not be collected only at one side. By guiding the dust to a larger space, a user may be able to delay the time to remove the dust.

In accordance with an embodiment of the present disclosure, as driving performance and cleaning performance are able to be enhanced and at the same time, as the efficiency of the space at an inside an autonomous cleaner at which structuring elements are disposed can be maximized, the miniaturization of the autonomous cleaner can be provided.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An autonomous cleaner, comprising:

a body having a housing forming at least a portion of an exterior appearance, the housing comprising a first housing disposed at a front of the body, and a second housing positioned at a rear of the first housing at a back of the body, the first housing and the second housing being separate from each other, at least a portion of a rear side of the first housing and at least a portion of a front side of the second housing being spaced apart from each other;

a brush unit, at a lower surface of the housing, configured to collect dust on a floor;

a dust collecting container configured to store the collected dust; and a power unit configured to supply power to drive the body, a connecting member having a pipe shape and being connected between a center of the rear side of the first housing and a center of the front side of the second housing, wherein the brush unit, the connecting member, the dust collecting container, and the power unit are linearly disposed along a longitudinal direction extending from the front to the back of the body, so that a central plane of the body passing both a center of the first housing and a center of the second housing passes through each of the brush unit, the connecting member, the dust collecting container, and the power unit, wherein the brush unit is disposed at the first housing, and the dust collecting container and the power unit are disposed at the second housing.

2. The autonomous cleaner of claim 1, wherein:

the dust collecting container is disposed at a rear of the brush unit, and the power unit is disposed at a rear of the dust collecting container.

3. The autonomous cleaner of claim 1, further comprising:

a bumper installed at a front of the first housing to surround at least a portion of the first housing.

4. The autonomous cleaner of claim 1, wherein:

a guide flow path to guide dust into the brush unit to increase an inlet force of the dust is formed at a lower surface of the first housing.

5. The autonomous cleaner of claim 1, further comprising:

an inlet motor coupled to a side surface of the dust collecting container and configured to provide a driving force to collect dust into the dust collecting container.

* * * * *